US010285496B2

(12) United States Patent
Hu

(10) Patent No.: US 10,285,496 B2
(45) Date of Patent: May 14, 2019

(54) HEIGHT ADJUSTMENT MECHANISM AND PLATFORM

(71) Applicant: DESIGNA INC., Foshan (CN)

(72) Inventor: Yajun Hu, Foshan (CN)

(73) Assignee: DESIGNA INC., Foshan (CN)

( * ) Notice: Subject to any disclaimer, the term of this patent is extended or adjusted under 35 U.S.C. 154(b) by 0 days.

(21) Appl. No.: 15/689,548

(22) Filed: Aug. 29, 2017

(65) Prior Publication Data

US 2017/0360192 A1 Dec. 21, 2017

Related U.S. Application Data

(63) Continuation-in-part of application No. 15/224,845, filed on Aug. 1, 2016.

(30) Foreign Application Priority Data

Jun. 3, 2016 (CN) ..... 2016 1 0388959

(51) Int. Cl.
*A47B 9/00* (2006.01)
*A47B 21/02* (2006.01)
*A47B 9/16* (2006.01)

(52) U.S. Cl.
CPC ..... *A47B 21/02* (2013.01); *A47B 9/16* (2013.01)

(58) Field of Classification Search
CPC ..... A47B 9/04; A47B 2200/0041; A47B 9/16; A47B 9/18; A47B 21/0314; A47B 2021/0321; A47B 2021/0335
(Continued)

(56) References Cited

U.S. PATENT DOCUMENTS 4,073,240 A 2/1978 Fly
4,519,649 A 5/1985 Tanaka et al.
(Continued)

FOREIGN PATENT DOCUMENTS

CN 202168584 3/2012
CN 102536126 7/2012
(Continued)

OTHER PUBLICATIONS

"Ergotron Work Fit-T Sit-Stand Desktop Workstation Stand with Table Mount"; [online] [retrieved Jan. 11, 2017]. Retrieved from the Internet: <URL: https://www.amazon.com/Ergotron-Sit-Stand-Desktop-Workstation-33-397-085/dp/B00QL6IGWQ/ref=sr_1_1?ie=UTF8&qid=1483986627&sr=8-1&keywords=ergotron+work+table>. (dated 2017) 8 pages.
(Continued)

*Primary Examiner* — Matthew W Ing
(74) *Attorney, Agent, or Firm* — Alston & Bird LLP

(57) ABSTRACT

An adjustable tray system is provided. The adjustable tray system may include a working table and a support member, where the support member may attach the working table with a supporting structure. The adjustable tray system may also include at least one adjustment mechanism. The adjustment mechanism may couple the working table with the support member such that an angle is formed between the support member and the working table. The adjustment mechanism may also allow angular adjustment of the working table such that the working table pivots about a rotation point of the adjustment mechanism. The adjustable tray system may be used in conjunction with a height adjustment platform, such as for an adjustable keyboard tray of a height adjustable desk.

20 Claims, 24 Drawing Sheets

(58) Field of Classification Search
USPC ..... 108/147, 27; 248/292.12, 292.13
See application file for complete search history.

(56) References Cited

U.S. PATENT DOCUMENTS

| | | | | |
|---|---|---|---|---|
| 4,558,553 | A * | 12/1985 | Kolk | A47B 95/043 108/27 |
| 5,649,493 | A | 7/1997 | Blume | |
| D395,969 | S | 7/1998 | Barlow-Lawson | |
| 5,823,120 | A | 10/1998 | Holmquist | |
| D424,828 | S | 5/2000 | Ko | |
| D428,279 | S | 7/2000 | Olson | |
| 6,116,557 | A * | 9/2000 | Choy | A47B 21/0314 108/93 |
| 6,148,739 | A * | 11/2000 | Martin | A47B 21/0314 108/50.01 |
| D435,368 | S | 12/2000 | Tzeng | |
| D436,268 | S | 1/2001 | Ko | |
| D447,646 | S | 9/2001 | Chang | |
| D464,212 | S | 10/2002 | Chen | |
| D486,669 | S | 2/2004 | Wang | |
| D499,576 | S | 12/2004 | Long | |
| D530,939 | S | 10/2006 | Nakamura | |
| D583,587 | S | 12/2008 | Lai | |
| D586,155 | S | 2/2009 | Lenterman | |
| D612,643 | S | 3/2010 | Rossini et al. | |
| 8,065,966 | B1 | 11/2011 | Bacon et al. | |
| D652,229 | S | 1/2012 | Madison | |
| D681,979 | S | 5/2013 | Keen et al. | |
| D691,223 | S | 10/2013 | Hao | |
| 8,671,853 | B2 | 3/2014 | Flaherty | |
| 8,800,454 | B2 | 8/2014 | Jones | |
| D716,074 | S | 10/2014 | Kitajima | |
| 9,049,923 | B1 | 6/2015 | Delagey et al. | |
| 9,055,810 | B2 | 6/2015 | Flaherty | |
| D733,476 | S | 7/2015 | Papic et al. | |
| 9,113,703 | B2 | 8/2015 | Flaherty | |
| 9,277,809 | B2 | 3/2016 | Flaherty et al. | |
| 9,289,058 | B2 | 3/2016 | Flaherty | |
| 9,326,598 | B1 | 5/2016 | West et al. | |
| D771,981 | S | 11/2016 | Flaherty et al. | |
| D771,982 | S | 11/2016 | Flaherty et al. | |
| 9,504,316 | B1 | 11/2016 | Streicher et al. | |
| 9,554,644 | B2 | 1/2017 | Flaherty et al. | |
| D781,617 | S | 3/2017 | Flaherty et al. | |
| D781,618 | S | 3/2017 | Flaherty et al. | |
| D781,619 | S | 3/2017 | Flaherty et al. | |
| D784,050 | S | 4/2017 | Flaherty et al. | |
| D785,386 | S | 5/2017 | Flaherty et al. | |
| D785,989 | S | 5/2017 | Flaherty et al. | |
| D814,214 | S | 4/2018 | Flaherty et al. | |
| 2003/0116066 | A1 | 6/2003 | Ken | |
| 2003/0140822 | A1 | 7/2003 | Seiler et al. | |
| 2003/0230222 | A1 | 12/2003 | Liu | |
| 2005/0045072 | A1 | 3/2005 | Rossini | |
| 2005/0284341 | A1 | 12/2005 | Klassy et al. | |
| 2008/0072803 | A1 | 3/2008 | Korber et al. | |
| 2012/0193495 | A1* | 8/2012 | Sugiyama | H04N 1/00493 248/292.12 |
| 2013/0139736 | A1 | 6/2013 | Flaherty | |
| 2013/0340655 | A1 | 12/2013 | Flaherty | |
| 2014/0020606 | A1 | 1/2014 | Benden | |
| 2014/0048671 | A1 | 2/2014 | Tsai | |
| 2014/0123883 | A1 | 5/2014 | Jennings et al. | |
| 2014/0158026 | A1 | 6/2014 | Flaherty | |
| 2015/0250303 | A1 | 9/2015 | Flaherty | |
| 2015/0289641 | A1 | 10/2015 | Ergun et al. | |
| 2015/0296976 | A1 | 10/2015 | Janowski et al. | |
| 2016/0073779 | A1 | 3/2016 | Ringlein | |
| 2016/0109056 | A1* | 4/2016 | Chen | B25H 1/12 248/277.1 |
| 2016/0158076 | A1 | 6/2016 | Flaherty et al. | |
| 2017/0354245 | A1 | 12/2017 | Martin et al. | |
| 2017/0360192 | A1 | 12/2017 | Hu | |
| 2018/0055214 | A1 | 3/2018 | Kim et al. | |
| 2018/0103752 | A1 | 4/2018 | Zhong | |
| 2018/0140089 | A1 | 5/2018 | Black burn | |

FOREIGN PATENT DOCUMENTS

| | | |
|---|---|---|
| CN | 203873238 | 10/2014 |
| CN | 204541230 | 8/2015 |
| CN | 105901923 | 8/2016 |
| DE | 29614295 | 9/1996 |
| SE | 504292 | 12/1996 |

OTHER PUBLICATIONS

"FlexiSpot 35" Wide Platform Height Adjustable Standing Desk Riser"; [online] [retrieved Jan. 11, 2017]. Retrieved from the Internet: <URL: https://www.amazon.com/FlexiSpot-Platform-Adjustable-Removable-M2B-M-SIZE/dp/B01HPE05BM/ref=sr_1_1?ie=UTF8&qid=1483986590&sr=8-1&keywords=flexispot+35+riser>. (dated 2017) 9 pages.

"Halter ED-258 Preassembled Height Adjustable Desk Sit / Stand Desk Elevating Desktop"; [online] [retrieved Jan. 11, 2017]. Retrieved from the Internet: <URL: https://www.amazon.com/Halter-ED-258-Preassembled-Adjustable-Elevating/dp/B01BMULFAA/ref= sr_1_fkmr0_1?ie=UTF8&qid=1483986452&sr=8-1-fkmr0&keywords=Halter+ED-258+Pre+Desk+Elevating+Desk>. (dated 2017) 9 pages.

"Rocelco ADR Height Adjustable Sit/Stand Desk Computer Riser"; [online] [retrieved Jan. 11, 2017]. Retrieved from the Internet: <URL: https://www.amazon.com/Rocelco-ADR-Adjustable-Computer-Capacity/dp/B015GCGOD8/ref=sr_1_1?ie=UTF8&qid=1483986493&sr=8-1&keywords=rocelco+adr>. (dated 2017) 8 pages.

"Varidesk—Height-Adjustable Standing Desk"; [online] [retrieved Jan. 11, 2017]. Retrieved from the Internet: <URL: https://www.amazon.com/VARIDESK-Height-Adjustable-Standing-Cubicles-Corner/dp/B017BUXRRE/ref=sr_1_1?ie=UTF8&qid=1483986540&sr=8-1-spons&keywords=VARISDESK-Height-Adjustable-Standing-Desk&psc=1>. (dated 2017) 8 pages.

Office Action from U.S. Appl. No. 15/224,845, dated Sep. 21, 2017, 15 pages.

Fancierstudio, posted at Amazon.com, posted on Dec. 20, 2016, site visited Jun. 20, 2018. online, available from internet: https://www.annazon.conn/dp/B01NCKI U70.

iMovR, posted at Amazon.com, posted on Jan. 30, 2017, site visited Jun. 20, 2018. online, available from internet: https://www.amazon.com/ iMovR-Standing-Converter-Ergonomic-Keyboard/dp/B074XMZ7MN.

Office Action for U.S. Appl. No. 15/224,845 dated Jun. 26, 2018, 9 pages.

Office Action for U.S. Appl. No. 29/598,176 dated Jun. 27, 2018, 8 pages.

Stand Steady, posted at Amazon.com, posted on Jan. 3, 2017, site visited Jun. 20, 2018. online, available from internet: https://www.annazon.conn/Stand-Steady-Award-Winning-Spring-Assisted-Adjustable/dp/B01N98WU1E.

International Search Report and Written Opinion for Application No. PCT/CN2016/108694 dated Jun. 3, 2016, 10 pages.

Office Action for U.S. Appl. No. 15/224,845, dated Mar. 13, 2018, 10 pages.

* cited by examiner

HEIGHT ADJUSTMENT MECHANISM AND PLATFORM

CROSS-REFERENCE TO RELATED APPLICATIONS

This application is a continuation-in-part of U.S. application Ser. No. 15/224,845, filed Aug. 1, 2016, and entitled "HEIGHT ADJUSTMENT MECHANISM, PLATFORM AND METHOD" and U.S. Design application Ser. No. 29/598,176, filed Mar. 23, 2017, and entitled "HEIGHT ADJUSTMENT PLATFORM," each of which claim priority to CN Application No. 201610388959.6, filed Jun. 6, 2016, which applications are incorporated by reference herein in their entirety.

FIELD OF THE INVENTION

The subject matter herein generally relates to a height adjustment mechanism, platform and method, and particularly to a height adjustment mechanism, platform and method used in office.

BACKGROUND

In recent years, with the development and popularization of computer technology, more and more people can work or study by computer. To maintain a good posture to prevent occupational injuries, height adjustment platforms can be sold on the market to meet the need of adjusting the height of office supplies.

The existing height adjustment platform may be a desk in which the height can be adjusted according to the need of the user. The height adjustment platform can include a height adjustment mechanism which is manually driven by the hands of the user. That is, the user lifts or moves down the existing height adjustment platform completely according to their hands. However, manual operation may be not convenient for the user to operate the height adjustment platform.

In general, the height adjustment platform can include a bottom part, a top part, a lifting mechanism, and a locking mechanism. The lifting mechanism and the locking mechanism can be connected between the bottom part and the top part. The locking mechanism can include a number of position holes or position grooves defined on the bottom of the top part, and a position bolt mounted on the lifting mechanism. To adjust the height of the top part, the user would need to pull out the position bolt from the position hole or position groove, and adjust the distance between the top part and the bottom part, and then insert the position bolt into the position hole or position groove to position the top part. However, the structure of the height adjustment platform may be complex, and the lifting height may be limited by the location of each position hole.

In addition, the height adjustment mechanism of the existing height adjustment platform can be generally manually driven by the hands of the user. The user lifts or moves down the existing height adjustment platform completely according to their hands. A connecting structure and a locking structure can be positioned on the bottom of the top part of existing height adjustment platform to increase the weight of the top part. Thus, it costs time and energy to lift or move down the top part, and it is not convenient for the user to lift or move down the top part.

However, because the lifting mechanism can be directly hinged to the bottom part and the top part, the lifting mechanism must rotate 0-90 degrees to lift the top part. In this way, the top part must horizontally move a long distance during lifting the top part. As such, a large operating space is needed to lift the height adjustment platform.

The user manually lifts or moves down the top part to rotate the lifting arm to lift or move down the existing height adjustment platform. However, the height adjustment method of the existing height adjustment platform is not convenient to operate, and costs time and energy.

SUMMARY OF THE INVENTION

An objective of the present invention is to provide a height adjustment mechanism having a simple structure, being applied on any one product which is needed to be adjusted the height thereof, and being convenient to use. The present invention further provides a height adjustment platform including the height adjustment mechanism. The height adjustment is convenient to use and decreases the operation space to improve the universality. The present invention further provides a height adjustment method.

The above objectives of the present invention can be achieved by the following technical scheme. A height adjustment mechanism includes a lifting arm, a driving mechanism configured to drive and lock the lifting arm, and a control switch configured to control the driving mechanism; the driving mechanism is coupled to the lifting arm, and an angle θ is formed between the driving mechanism and the lifting arm.

In the above technical scheme, the height adjustment mechanism controls the driving mechanism via the control switch to drive the lifting arm, so as to drive the working table to move up and down. Because the angle θ is formed between the driving mechanism and the lifting arm, which ensures the driving mechanism can apply force to the lifting arm to let the operation of the height adjustment mechanism become convenient.

More specifically, the lifting arm comprises two parallel rods, a first joint device, and a second joint device; two ends of each rod is respectively coupled to the first joint device and the second joint device; the two rods, the first joint device, and the second joint device are coupled end to end to cooperatively form a parallelogram structure; when in use, the first joint device is coupled to a lifting surface, the second joint device is coupled to a support surface.

The lifting arm comprises two parallel rods, a first joint device, and a second joint device; two ends of each rod is respectively coupled to the first joint device and the second joint device; the two rods, the first joint device, and the second joint device are coupled end to end cooperatively forming a parallelogram structure; when in use, the first joint device is vertical to the lifting surface, the second joint device is vertical to the support surface.

Both of the first joint device and the second joint device are not used as connecting members, but used as limiting members. Because the first joint device is vertical to the lifting surface and the second joint device is vertical to the support surface, which can limit the rotation angle of the lifting arm to let the working table substantially move vertically, so as to decrease the operation space.

There are three ways to form the angle θ between the driving mechanism and the lifting arm which is coupled to the driving mechanism. One way, the driving mechanism is positioned in the parallelogram structure, and the angle θ is formed between the driving mechanism and the rod of the lifting arm.

The second way, the driving mechanism comprises a support rod extending into the parallelogram structure to connect the rod of the lifting arm, and the angle θ is formed between the support rod and the rod of the lifting arm.

The third way, the driving mechanism is positioned outside of the parallelogram structure and coupled to the rod of the lifting arm, and the angle θ is formed between the driving mechanism and the rod of the lifting arm.

The driving mechanism is positioned into the parallelogram structure to prevent the working table from inclining, and to decrease the weight of the working table. Thus the user can use less force to lift or move down the working table, and the driving force of the driving mechanism can be decreased to save costs.

A power device is integrated with the locking device to form the driving mechanism, or the driving mechanism comprises the power device and the locking device positioned apart from the power device.

The driving mechanism is a self-locking gas spring, the self-locking gas spring comprises a base body, a releasing rod, and a releasing head coupled to the base body via the releasing rod. The self-locking gas spring can be one industrial component which has functions of supporting, buffering, braking, height adjustment, and angle adjustment. The self-locking gas spring can stop at any position during its moving, and have a large locking force after it stops. Thus, the height adjustment mechanism can move the working table to a predetermined position which is located between the lowest point and the highest point of the working table to increase the utility of the height adjustment platform.

The driving mechanism can include other types of power device and locking device which are integrated with each other or positioned apart from each other, for example, a gas spring is used as the power device, and a mechanical locking device is used as the locking device.

The control switch comprises a control wire, a fasten member, and a handle mounted on the fasten member; a first end of the control wire is coupled to the handle, a second end of the control wire is coupled to the releasing head of the self-locking gas spring.

A height adjustment platform includes a first working table, a bottom bracket, at least one lifting arm, at least one driving mechanism configured to drive and lock the lifting arm, and at least one control switch configured to control the driving mechanism; two opposite ends of the lifting arms are separately coupled to the first working table and the bottom bracket, the driving mechanism is coupled to the lifting arm, and the angle θ is formed between the driving mechanism and the lifting arm.

In the above technical scheme, the height adjustment mechanism controls the driving mechanism via the control switch to drive the lifting arm, so as to drive the working table to move up and down. Because the angle θ is formed between the driving mechanism and the lifting arm, which ensures the driving mechanism can apply force to the lifting arm to let the operation of the height adjustment mechanism become convenient.

The lifting arm is rotatably coupled to the first working table and the bottom bracket; when in use, both of the lifting arm and the bottom bracket rotate an angle α ranging from 0 to 60 degrees. The lifting arm of the present invention is coupled to the bottom bracket via the first joint device and the second joint device. Because the first joint device is vertical to the lifting surface and the second joint device is vertical to the support surface, which can limit the rotation angle of the lifting arm, the rotation angle α between the lifting arm and the first working table or between the lifting arm and the bottom bracket ranges from 0 to 60 degrees. Because of the arrangement of the first joint device and the second joint device, the rotation angle of the lifting arm during lifting or moving down the first working table is small, and the first working table substantially moves vertically. Thus, the driving mechanism drives the lifting arm to move during the driven travel of the driving mechanism to let the lift during the height adjustment platform to be lifted to an ideal height thereof, and the first working table will not horizontally move a long distance during the process of rising and falling. So that, the operation space of the height adjustment platform can be decreased to improve the universality.

The height adjustment platform further includes two lifting arms and at least one connecting rod. The two lifting arms are positioned on opposite sides between the first working table and the bottom bracket, the connecting rod is positioned between the two lifting arms, and two opposite ends of the connecting rod are coupled to the two lifting arms.

The height adjustment platform further includes a second working table positioned below the first working table and at least one support arm. The second working table is coupled to the bottom of the first working table via the support arm.

An area of the second working table is more than a half of the area of the first working table.

A height adjustment method includes: applying a first working table, a bottom bracket, at least one lifting arm, at least one driving mechanism configured to drive and lock the lifting arm, and at least one control switch configured to control the driving mechanism, wherein two ends of the lifting arm are respectively coupled to the first working table and the bottom bracket, the angle θ is formed between the driving mechanism and the lifting arm; controlling the driving mechanism via the control switch to move the lifting arm which is coupled to the driving mechanism with the angle θ formed between the driving mechanism and the lifting arm, so as to move up or move down the first working table.

The process of controlling the driving mechanism via the control switch to move the lifting arm which is coupled to the driving mechanism with the angle θ formed between the driving mechanism and the lifting arm to move up or move down the first working table includes two steps.

Firstly, the driving mechanism is controlled to start, and the first working is lifted or pressed, such that the driving mechanism can jack up the lifting arm which is coupled to the driving mechanism with the angle θ formed between the driving mechanism and the lifting arm to lift the first working table, or the driving mechanism can shrink the lifting arm which is coupled to the driving mechanism with the angle θ formed between the driving mechanism and the lifting arm to move down the first working table.

Secondly, after the first working table moves to a predetermined position which is located between the lowest point and the highest point of the first working table, the driving mechanism is controlled to be closed, so as to lock the first working table to the predetermined position.

The height adjustment platform of the present invention is used according to the follow method.

Firstly, the user can hold the handle and open the handle, and then the releasing head of the self-locking gas spring can be opened under the control of the height adjustment platform, and then the user can subsidiarily lift or press the first working table lightly, the releasing rod can extend to jack up the lifting arm to raise the first working table, or the releasing rod can shrink to move down the lifting arm and the first working table.

Secondly, after the first working table moves to the predetermined position between the lowest point and the highest point of the first working table, the user can release the handle to reset the control switch and the releasing head, and then the first working table can be locked on the predetermined position by the self-locking gas spring.

With the above technical scheme, the present invention includes at least the following advantages and beneficial effects: firstly, the height adjustment mechanism can be applied on any product which is needed to adjust height, so as to solve the problem of laborious and operating inconvenience caused by the manual power for lifting; secondly, the height adjustment platform can have properties of simple structure, strong practicality, and convenient operation, so as to solve the problem of laborious and operating inconvenience caused by the manual power for lifting; thirdly, the operation space of the height adjustment platform of the present invention can be decreased, thus the height adjustment platform can have advantages of wide universality and extensive use-area; and forth, the height adjustment platform can be easily operated.

BRIEF DESCRIPTION OF THE DRAWINGS

Implementations of the present technology will now be described, by way of example only, with reference to the attached figures.

Figure 1:
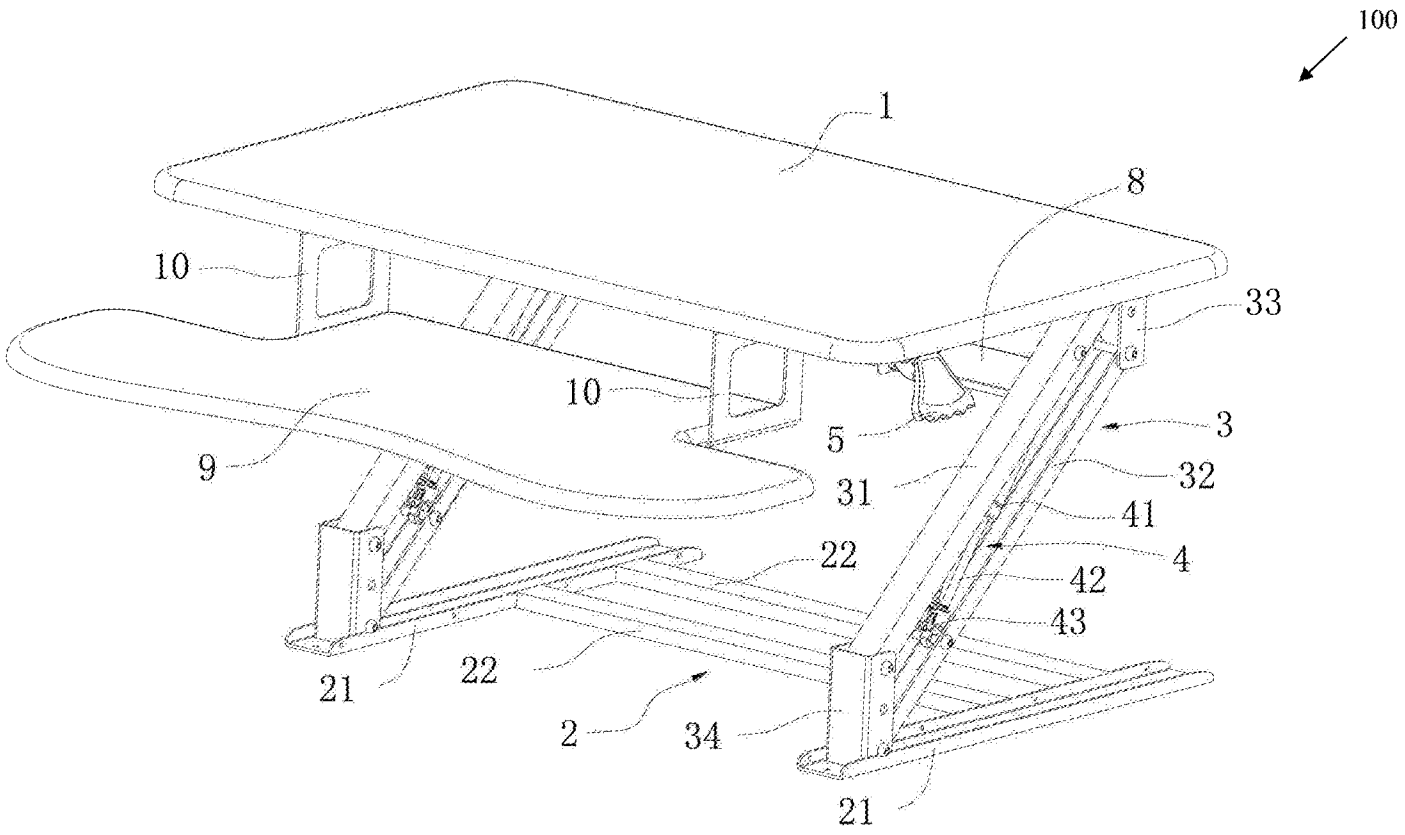
FIG. 1 is an isometric view of a first embodiment of a height adjustment platform.
Figure 2:
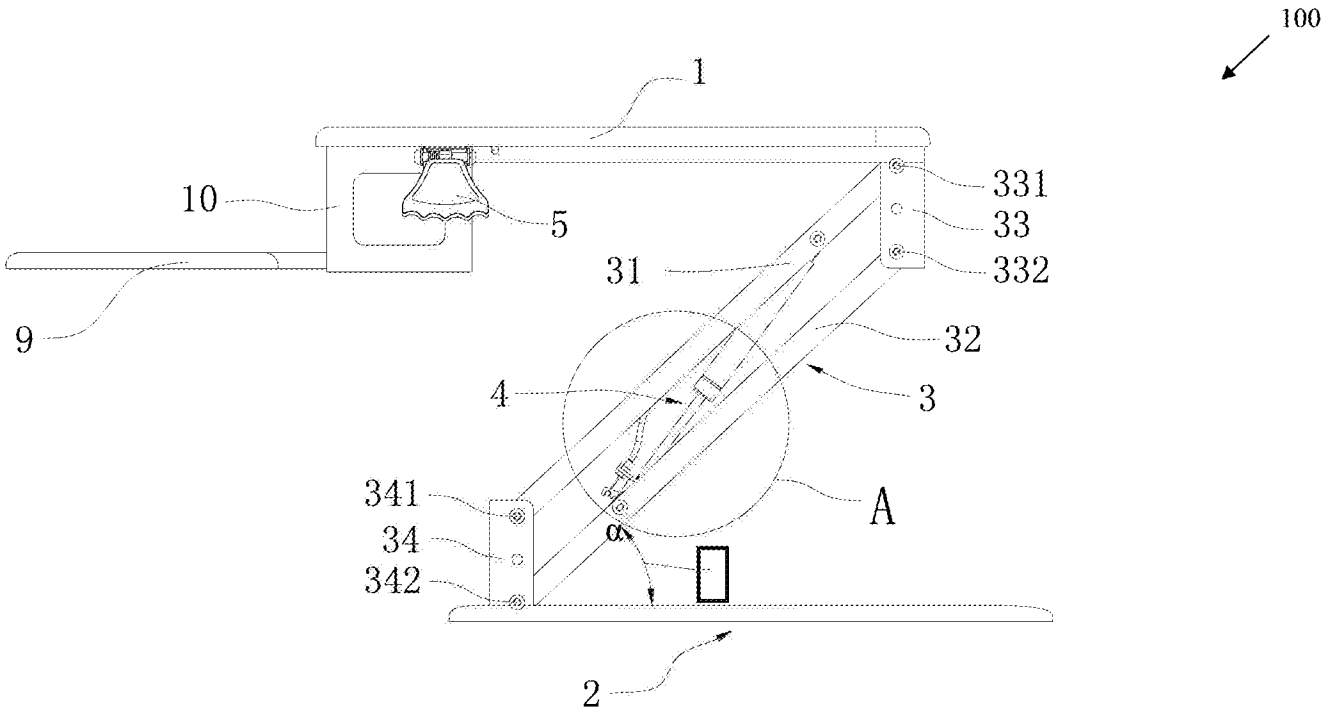
FIG. 2 is a right side elevational view of the height adjustment platform of FIG. 1.
Figure 3:
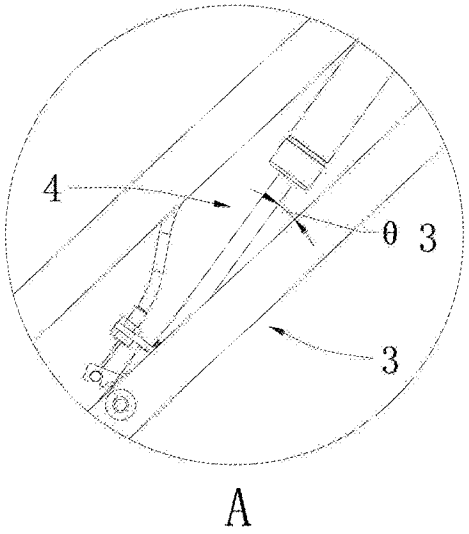
FIG. 3 is an enlarge view of the portion A of FIG. 2.
Figure 4:
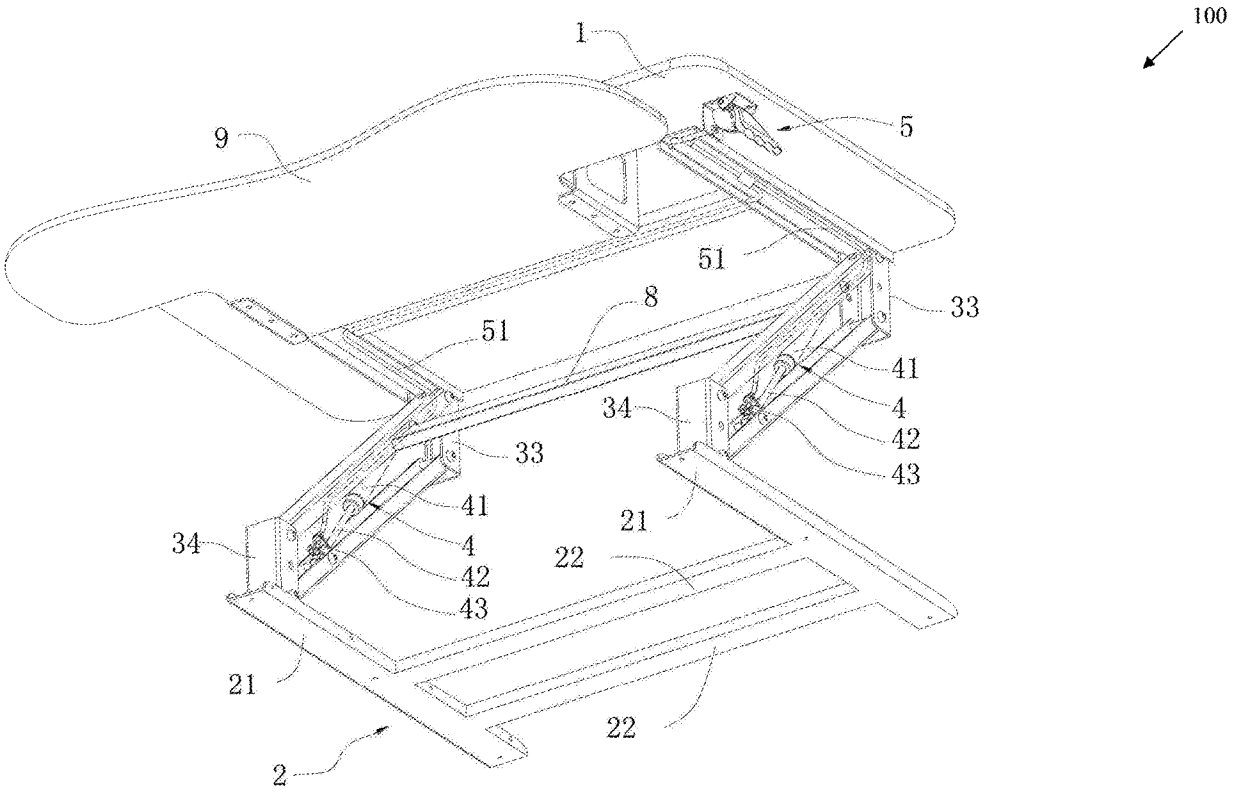
FIG. 4 is similar to FIG. 1, but viewed from another angle.
Figure 5:
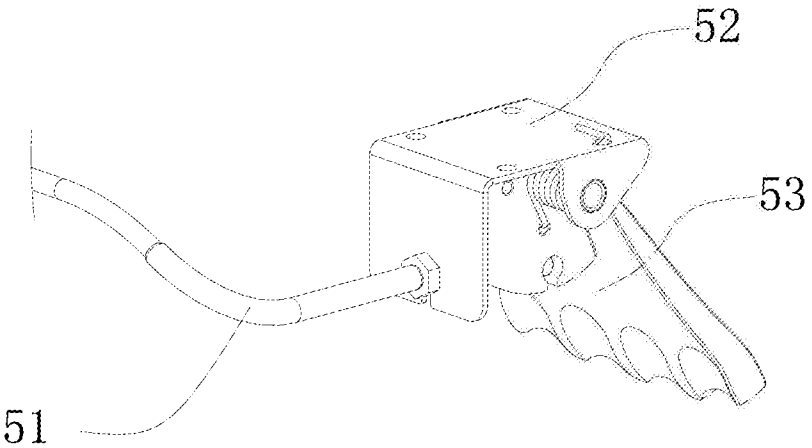
FIG. 5 is an isometric view of a control switch for controlling the height adjustment platform.

In the drawings, reference number 1 refers to the first working table, reference number 2 refers to the bottom bracket, reference number 21 refers to the pole, reference number 22 refers to the strengthening rib, reference number 3 refers to the lifting arm, reference number 31 refers to the first rod, reference number 32 refers to the second rod, reference number 33 refers to the first joint device, reference number 331 refers to the first hinge point between the first rod and the first joint device, reference number 332 refers to the third hinge point between the second rod and the first joint device, reference number 34 refers to the second joint device, reference number 341 refers to the second hinge point between the first rod and the second joint device, reference number 342 refers to the forth hinge point between the second rod and the hinge device, reference number 4 refers to the self-locking gas spring, reference number 41 refers to the base body, reference number 42 refers to the releasing rod, reference number 43 refers to the releasing head, reference number 5 refers to the control switch, reference number 51 refers to the control wire, reference number 52 refers to the fasten member, reference number 53 refers to the handle, reference number 8 refers to the connecting rod, reference number 9 refers to the second working table, reference number 10 refers to the support arm, reference number 11 refers to the support rod, reference number 12 refers to the power device, reference number 13 refers to the locking device, reference number 131 refers to the telescopic pole 131, reference number 132 refers to the button switch, and reference number 14 refers to the pushing rod.

DETAILED DESCRIPTION

It will be appreciated that for simplicity and clarity of illustration, where appropriate, reference numerals have been repeated among the different figures to indicate corresponding or analogous elements. In addition, numerous specific details are set forth to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure. The terms a "height adjustment platform" and a "height adjustable platform" may be interchangeable used to describe any of the embodiments of the present disclosure shown in FIGS. 1-12.

All of the angle θ described in the claims and the summary of the invention, and the angles $\theta_3$, $\theta_6$, $\theta_7$, and $\theta_9$ described in the embodiments refer to the angle formed between the driving mechanism and the lifting arm.

First Embodiment

FIGS. 1-5 illustrate a height adjustment platform 100 of a first embodiment. The height adjustment platform can include a first working table 1, a bottom bracket 2, two lifting arms 3, two driving mechanisms used to drive the lifting arms 3, and a control switch 5 configured to control the driving mechanism. Two ends of each lifting arm 3 can be rotatably coupled to the first working table 1 and the bottom bracket 2, respectively. When in use, the lifting arms 3 and the bottom bracket 2 can rotate an angle $\alpha$ ranging from about 0 to about 60 degrees. The driving mechanism can be mounted on one lifting arm 3, and there can be an angle $\theta_3$ formed between the driving mechanism and the corresponding lifting arm 3.

The lifting arm 3 can include a first rod 31, a second rod 32, a first joint device 33, and a second joint device 34. The first rod 31 can be parallel to the second rod 32. Two ends of the first rod 31 can be respectively coupled to the first joint device 33 and the second joint device 34. Two ends of the second rod 32 can be respectively coupled to the first joint device 33 and the second joint device 34. The first rod 31 can be coupled to the first joint device 33 via a first hinge point 331. The first rod 31 can be coupled to the second joint device 33 via a second hinge point 341. The second rod 32 can be coupled to the first joint device 33 via a third hinge point 332. The second rod 32 can be coupled to the second joint device 34 via a forth hinge point 342. The first rod 31, the second rod 32, the first joint device 33, and the second joint device 34 can be connected end to end, such that the first rod 31, the second rod 32, the first joint device 33, and the second joint device 34 cooperatively form a parallelogram structure.

A power device can be integrated with the locking device to form the driving mechanism. The driving mechanism can be a self-locking gas spring 4. The self-locking gas spring 4 can be positioned in the parallelogram structure of the lifting arm 3. There can be an angle $\theta_3$ formed between the self-locking gas spring 4 and the second rod 32 of the lifting arm 3. The self-locking gas spring 4 can include a base body 41, a releasing rod 42, and a releasing head 43 coupled to the base body 41 via the releasing rod 42. The control switch 5 can be positioned on the bottom of the first working table 1. The control switch 5 can include a control wire 51, a fasten member 52 mounted on the bottom of the first working table 1, and a handle 53 mounted on the fasten member 52. A first end of the control wire 51 can be coupled to the handle 53, and the second end of the control wire 51 can be coupled to the releasing head 43 of the self-locking gas spring 4. The height of the first working table 1 can be free to select from heights between the lowest point and the highest point according to adjust the self-locking gas spring 4, thus increasing the utility of the height adjustment platform.

Both of the first joint device 33 and the second joint device 34 can be a hinge. Two ends of the lifting arm 3 can be respectively coupled to the first working table 1 and the bottom bracket 2. A first end of the lifting arm 3 can be coupled to the first working table 1 via the first joint device 33, and the second end of the lifting arm 3 can be coupled to the bottom bracket 2 via the second joint device 34. The first joint device 33 can be vertically positioned to the first working table 1. The second joint device 34 can be vertically positioned to the bottom bracket 2. When in use, both of the lifting arms 3 and the bottom bracket 2 can rotate an angle $\alpha$ ranging from about 0 to about 60 degrees. The lifting arm 3 can rotate a small angle to lead the first working table 1 to be substantially vertically lifted according to the first joint device 33 and the second joint device 34. As thus, when the first working table 1 is lifted, the first working table 1 cannot horizontally move a long distance to increase an operation space.

The height adjustment platform can include a connecting rod 8 positioned between the two lifting arms 3. Two opposite ends of the connecting rod 8 can be respectively coupled to the two lifting arms 3. The connecting rod 8 can be configured to enhance the strength and the stability of structure.

The height adjustment platform can also include a second working table 9 and two support arms 10. Both of the second working table 9 and the two support arms 10 can be positioned below the first working table 1. The second working table 9 can be coupled to the bottom of the first working table 1 via the support arms 10. The second working table 9 can be used as a keyboard tray. An area of the second working table 9 can be more than a half of the area of the first working table 1.

The bottom bracket 2 can include two parallel poles 21. Preferably, at least one strengthening rib 22 can be positioned between the two parallel poles 21.

A height adjustment method can include: applying a first working table 1, a bottom bracket 2, at least one lifting arm 3, at least one driving mechanism configured to drive and lock the lifting arm 3, and at least one control switch 5 configured to control the driving mechanism. Wherein two ends of the lifting arm 3 can be respectively coupled to the first working table 1 and the bottom bracket 2, a self-locking gas spring can be used as the driving mechanism and coupled to the lifting arm 3, an angle $\theta_3$ can be formed between the self-locking gas spring 4 and a second rod 32 of the lifting arm 3.

The control switch 5 can control the driving mechanism to move the lifting arm 3 which is coupled to the driving mechanism with the angle $\theta_3$ formed between the driving mechanism and the lifting arm, so as to lift the first working table 1.

The height adjustment method includes two steps.

Firstly, the driving mechanism is controlled to start, and the first working is lifted or pressed, such that the driving mechanism can jack up the lifting arm 3 which is coupled to the driving mechanism with the angle $\theta_3$ formed between the driving mechanism and the lifting arm to lift the first working table 1, or the driving mechanism can shrink the lifting arm which is coupled to the driving mechanism with the angle $\theta_3$ formed between the driving mechanism and the lifting arm to move down the first working table 1.

Secondly, after the first working table 1 moves to a predetermined position which is located between the lowest point and the highest point of the first working table 1, the driving mechanism is controlled to be closed, so as to lock the lifting arm 3 and lock the first working table 1 to the predetermined position.

The height adjustment platform of the present invention is used according to the follow method.

Firstly, the user can hold the handle 53 and open the handle 53, and then the releasing head 43 of the self-locking gas spring 4 can be opened according to the control wire 51, and then the user can subsidiarily lift or press the first working table 1 lightly, the releasing rod 42 of the self-locking gas spring 4 can extend to jack up the lifting arm 3 to raise the first working table 1, or the releasing rod 42 of the self-locking gas spring 4 can shrink to move down the lifting arm 3 and the first working table 1.

Secondly, after the first working table 1 moves to the predetermined position between the lowest point and the highest point of the first working table 1, the user can release the handle 53 to reset the control switch 5, the releasing head 43 can rest according to controlling the self-locking gas spring 4 via the control wire 51, and then the first working table 1 can be locked on the predetermined position by the self-locking gas spring 4.

Second Embodiment

Figure 6:
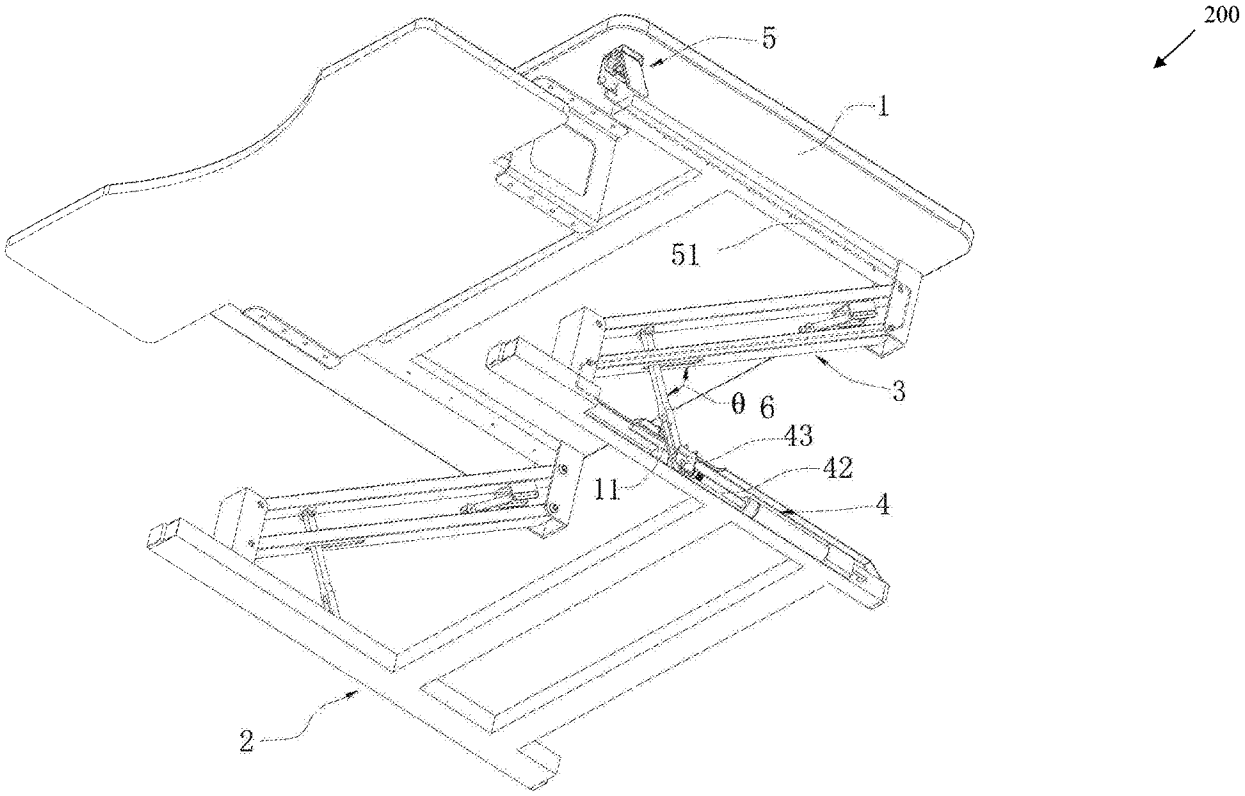
FIG. 6 is an isometric view of a second embodiment of a height adjustment platform.

FIG. 6 illustrates a height adjustment platform 200 of a second embodiment similar to the height adjustment platform of the first embodiment. The difference can be that the self-locking gas spring 4 used as the driving mechanism can be positioned on the bottom bracket 2, the driving mechanism can include a support rod 11. A first end of the support rod 11 can be coupled to the releasing head 43, and a second end of the support rod 11 can extend into the parallelogram structure to connect the rod of the lifting arm 3. An angle $\theta_6$ can be formed between the support rod 11 and the rod of the lifting arm 3.

When in use, the releasing rod 42 of the self-locking gas spring 4 can extend to jack up the lifting arm 3 and the working table via the support rod 11, or the releasing rod 42 of the self-locking gas spring 4 can shrink to move down the lifting arm 3 and the working table via the support rod 11.

The driving mechanism can be positioned on the bottom bracket 2 to prevent the first working table 1 from inclining, and to decrease the weight of the first working table 1.

Other aspects of this embodiment are like those of the first embodiment.

Third Embodiment

Figure 7:
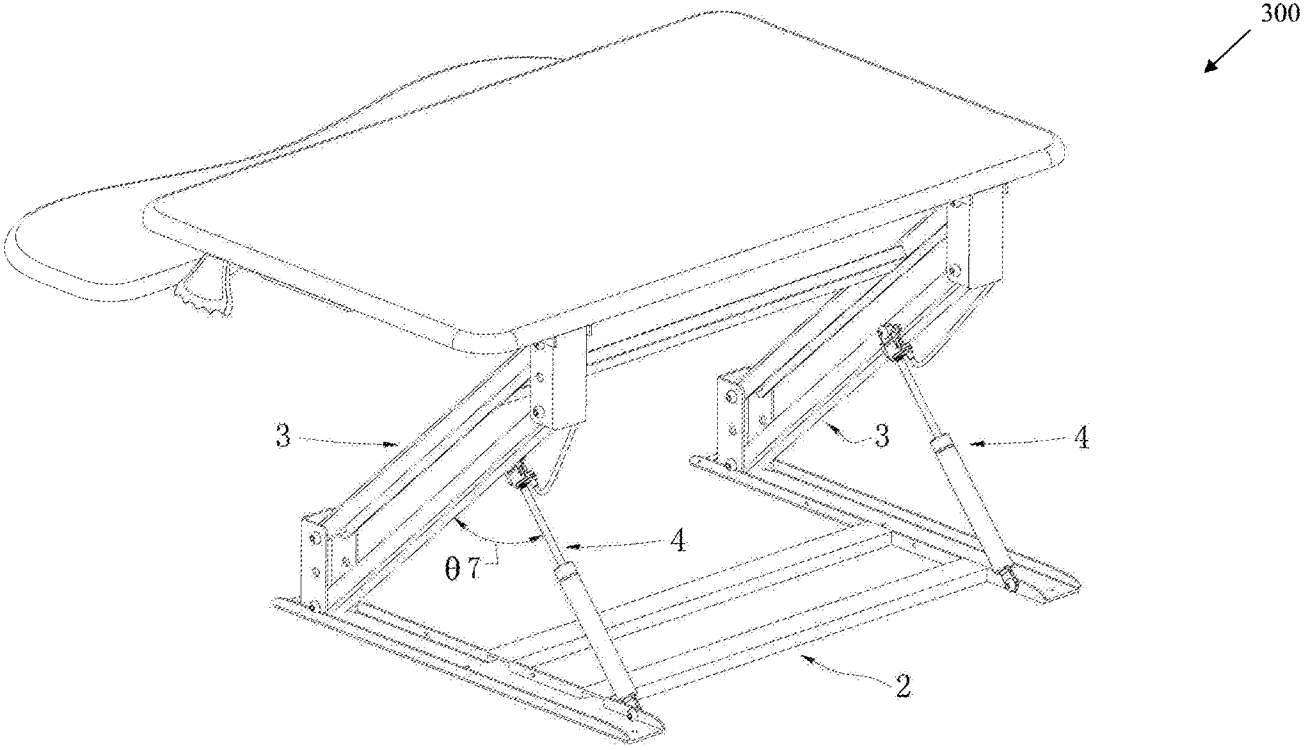
FIG. 7 is an isometric view of a third embodiment of a height adjustment platform.

FIG. 7 illustrates a height adjustment platform 300 of a third embodiment similar to the height adjustment platform of the first embodiment. The difference can be that the self-locking gas spring 4 used as the driving mechanism can be positioned outside of the parallelogram structure, for example, the self-locking gas spring 4 can be positioned on the bottom bracket 2. The self-locking gas spring 4 can be coupled to the rod of the lifting arm 3, and an angle $\theta_7$ can be formed between the rod of the lifting arm 3 and self-locking gas spring 4.

Other aspects of this embodiment are like those of the first embodiment.

Fourth Embodiment

Figure 8:
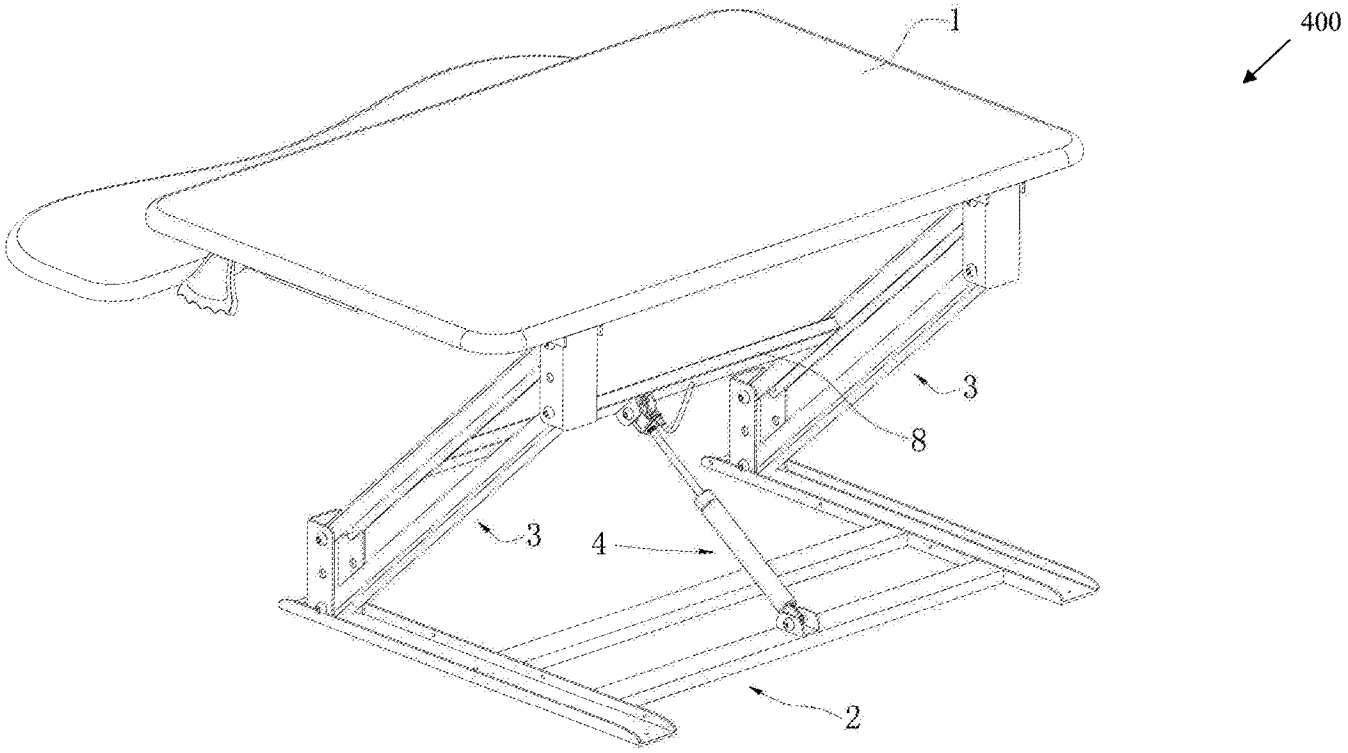
FIG. 8 is an isometric view of a forth embodiment of a height adjustment platform.

FIG. 8 illustrates a height adjustment platform 400 of a forth embodiment similar to the height adjustment platform of the first embodiment. The difference can be that the self-locking gas spring 4 used as the driving mechanism can be positioned on the bottom bracket 2. An end of the self-locking gas spring 4 can be coupled to the connecting rod 8, and can be configured to drive the connecting rod 8. The self-locking gas spring 4 can move the connecting rod 8. The lifting arm 3 can be rotatably coupled to the first working table 1 and the bottom bracket 2.

Other aspects of this embodiment are like those of the first embodiment.

Fifth Embodiment

Figure 9:
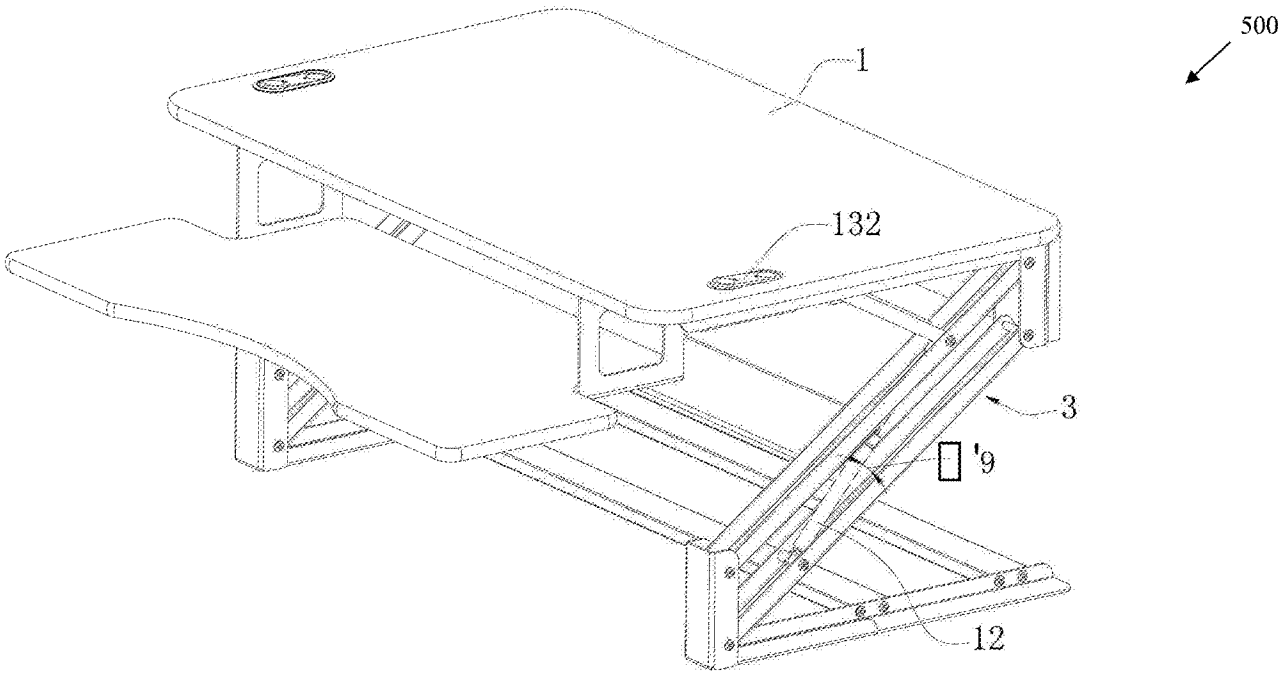
FIG. 9 and FIG. 10 cooperatively show an isometric view of a fifth embodiment of a height adjustment platform.
Figure 10:
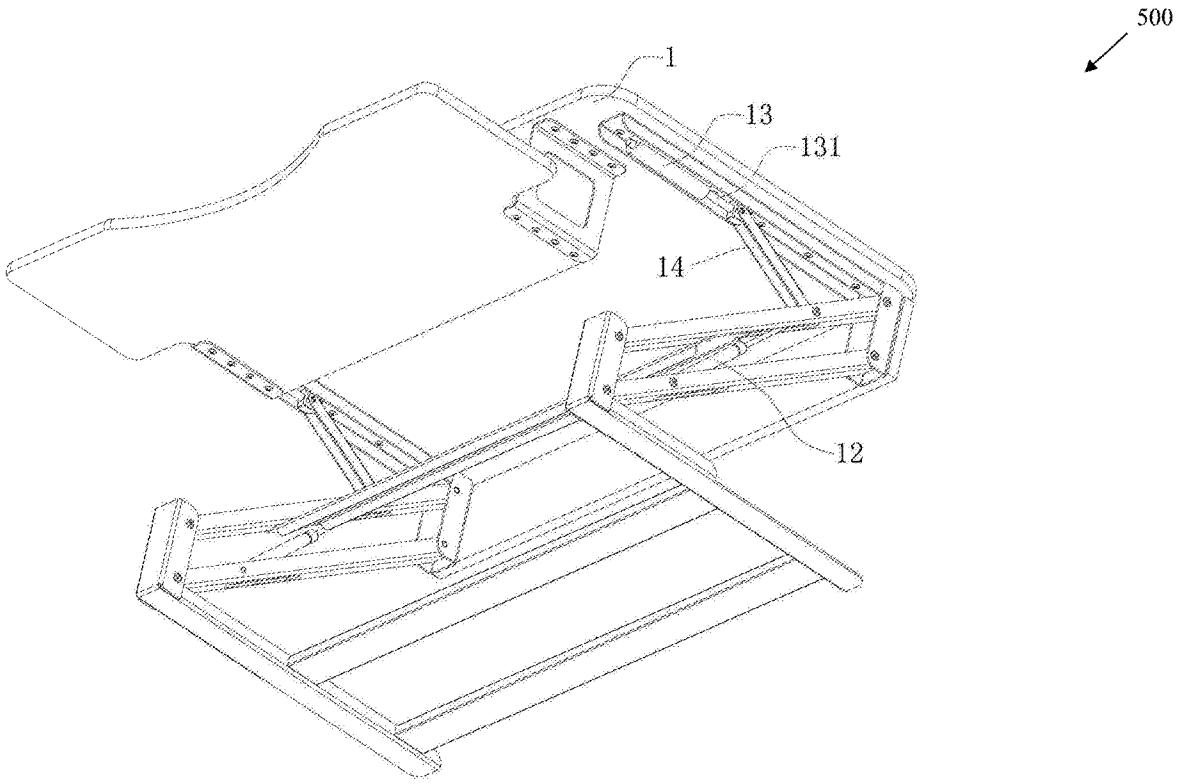

FIGS. 9 and 10 illustrate a height adjustment platform 500 of a fifth embodiment similar to the height adjustment platform of the first embodiment. The power device 12 and the locking device 13 can be positioned apart from each other, and an angle $\theta_9$ can be formed between the power device 12 and the lifting arm 3.

A gas spring can be used as the power device 12. A mechanical locking device can be used as the locking device 13. The locking device 13 can include a telescopic pole 131 and a button switch 132. The telescopic pole 131 can be coupled to the power device 12 via a pushing rod 14. The button switch 132 of the locking device 13 can be configured to control the telescopic pole 131 to extend or to shrink. When the button switch 132 is opened, the telescopic pole 131 can be located on an extending state, and the user can move up and down the first working table 1 to the predetermined position according to the drive of the power device 12. When the first working table 1 is moved to the predetermined position, the user can close the button switch 132 to lock the first working table 1 on the predetermined position, and the telescopic pole 131 can be located on a locking state.

Other aspects of this embodiment are like those of the first embodiment.

Sixth Embodiment

Figure 11:
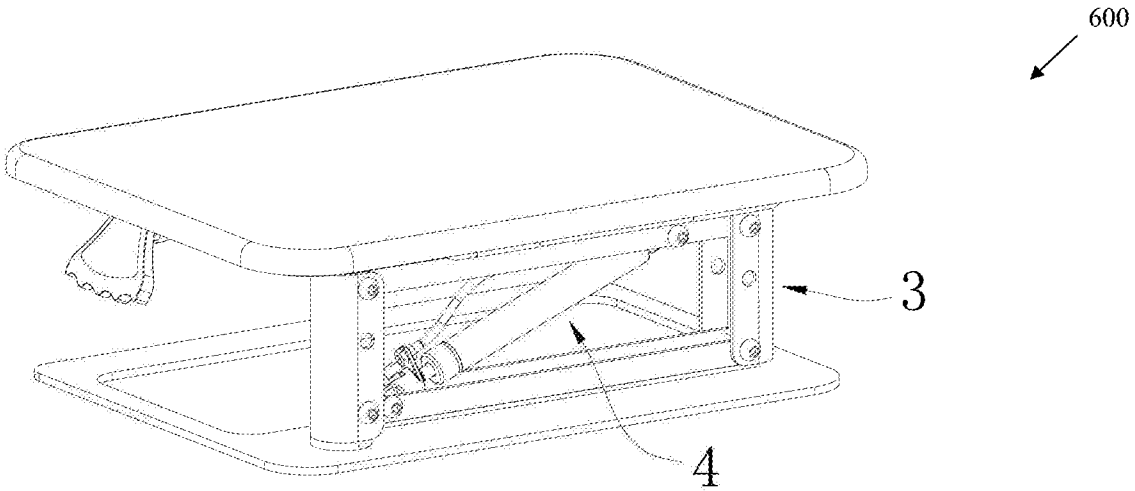
FIG. 11 is an isometric view of a sixth embodiment of a height adjustment platform.

FIG. 11 illustrates a height adjustment platform 600 of a sixth embodiment similar to the height adjustment platform of the first embodiment. The difference can be that the height adjustment platform can include one lifting arm 3, and one driving mechanism configured to drive and lock the lifting arm 3. The driving mechanism can be the self-locking gas spring 4. The height adjustment platform cannot include the connecting rod.

Other aspects of this embodiment are like those of the first embodiment.

Seventh Embodiment

Figure 12:
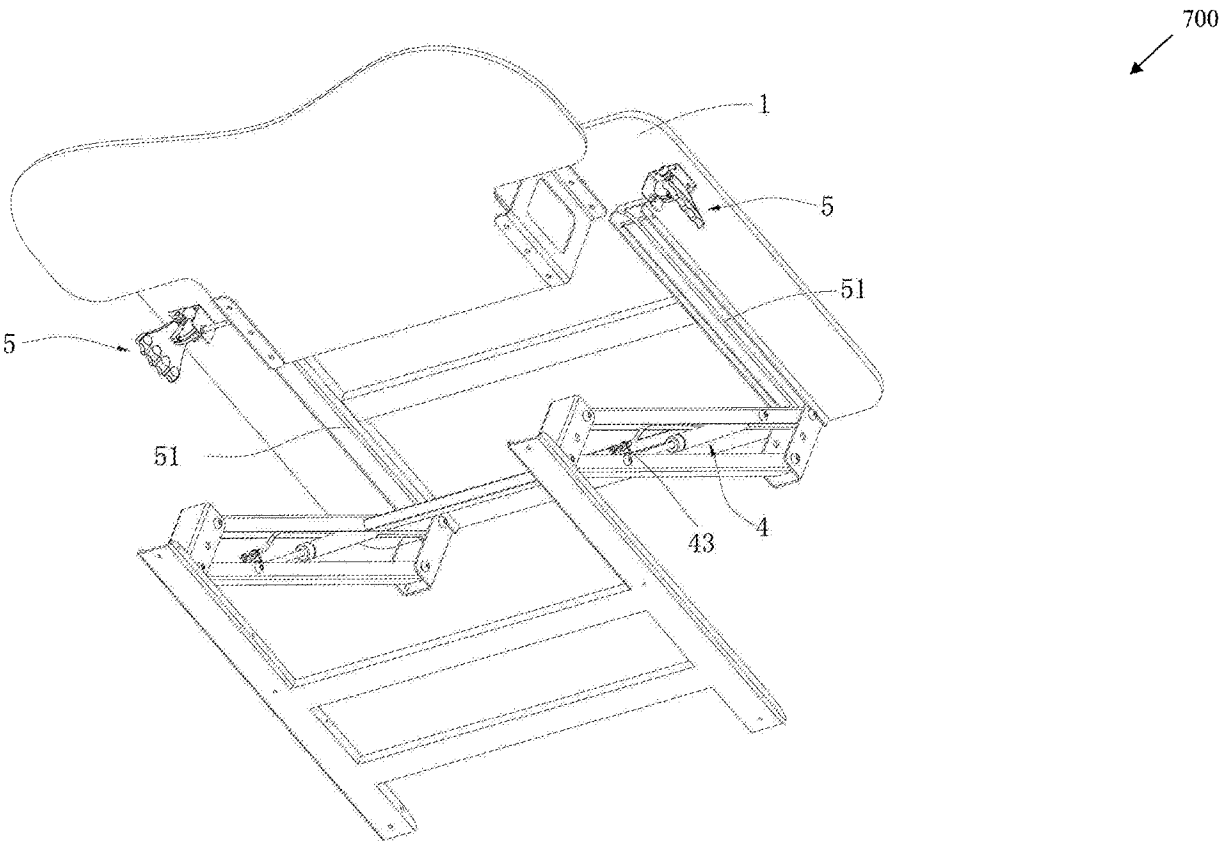
FIG. 12 is an isometric view of a seventh embodiment of a height adjustment platform.

FIG. 12 illustrates a height adjustment platform 700 of a seventh embodiment similar to the height adjustment platform of the first embodiment. The difference can be that the height adjustment platform can include two control switches 5 positioned on opposite sides of the bottom of the first working table 1. The two control switches 5 can be respectively coupled to the releasing head 43 of the self-locking gas spring 4 via the control wire 51. The two control switches 5 can be respectively operated by left hand and right hand of the user to improve the operation convenience.

Other aspects of this embodiment are like those of the first embodiment.

As described above, some height adjustment platform embodiments (e.g., height adjustment platforms 100, 200, 300, 400, 500, 600, and 700) may include, with reference to FIG. 1, a second working table 9 attached to the first working table 1 via support arm(s) 10. As shown in these embodiments, the second working table 9 may be affixed at a position defined by the support arm(s) 10 utilized to attach the second working table 9 to the first working table 1. In some embodiments, as described hereinafter with reference to FIGS. 21-24, a stopper may be utilized to attach the second working table to the first working table (e.g., as a support arm or the like).

Figure 21:
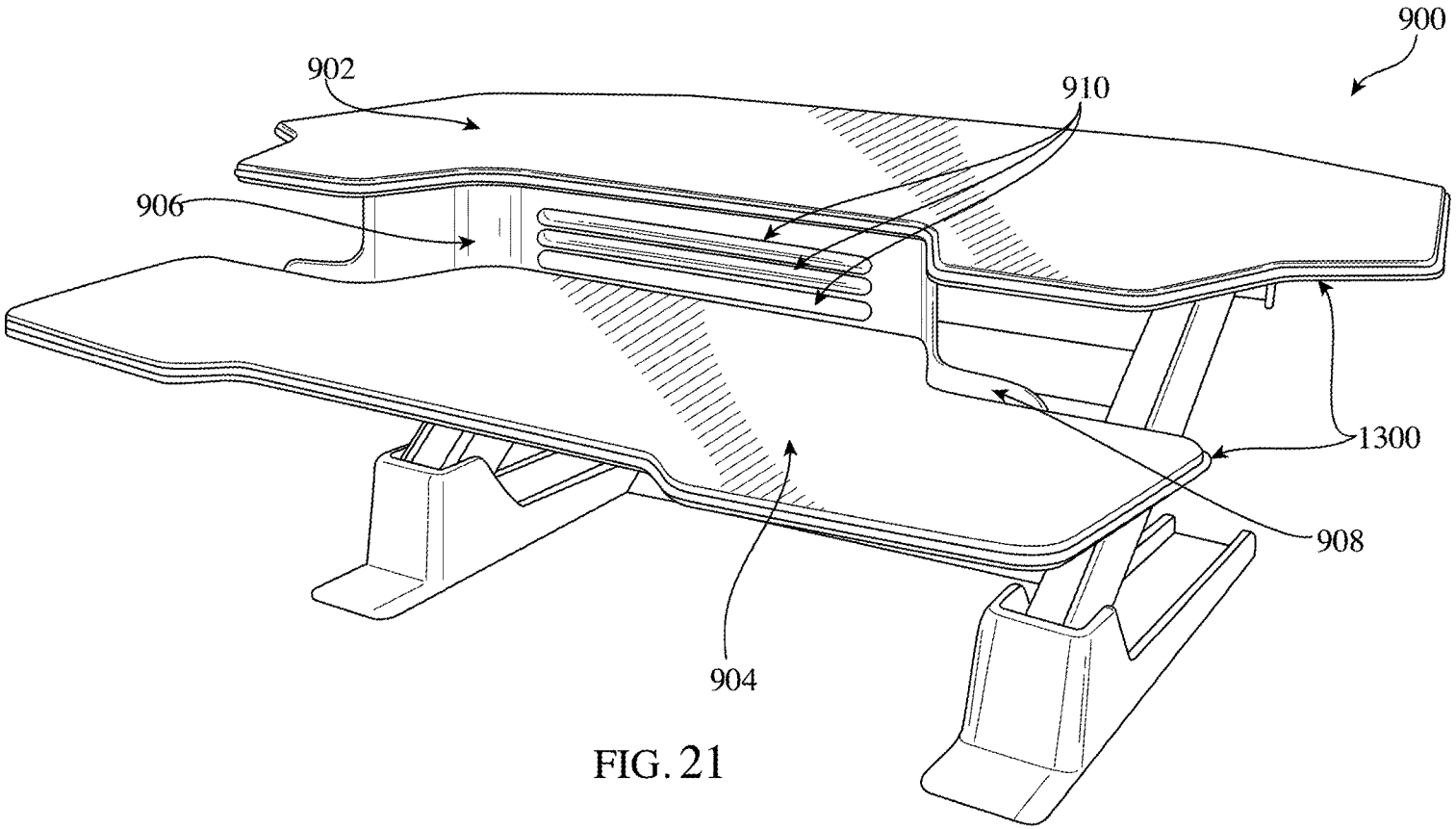
FIGS. 21-24 illustrate isometric views of a height adjustment platform with stopper, in accordance with some embodiments discussed herein.
Figure 22:
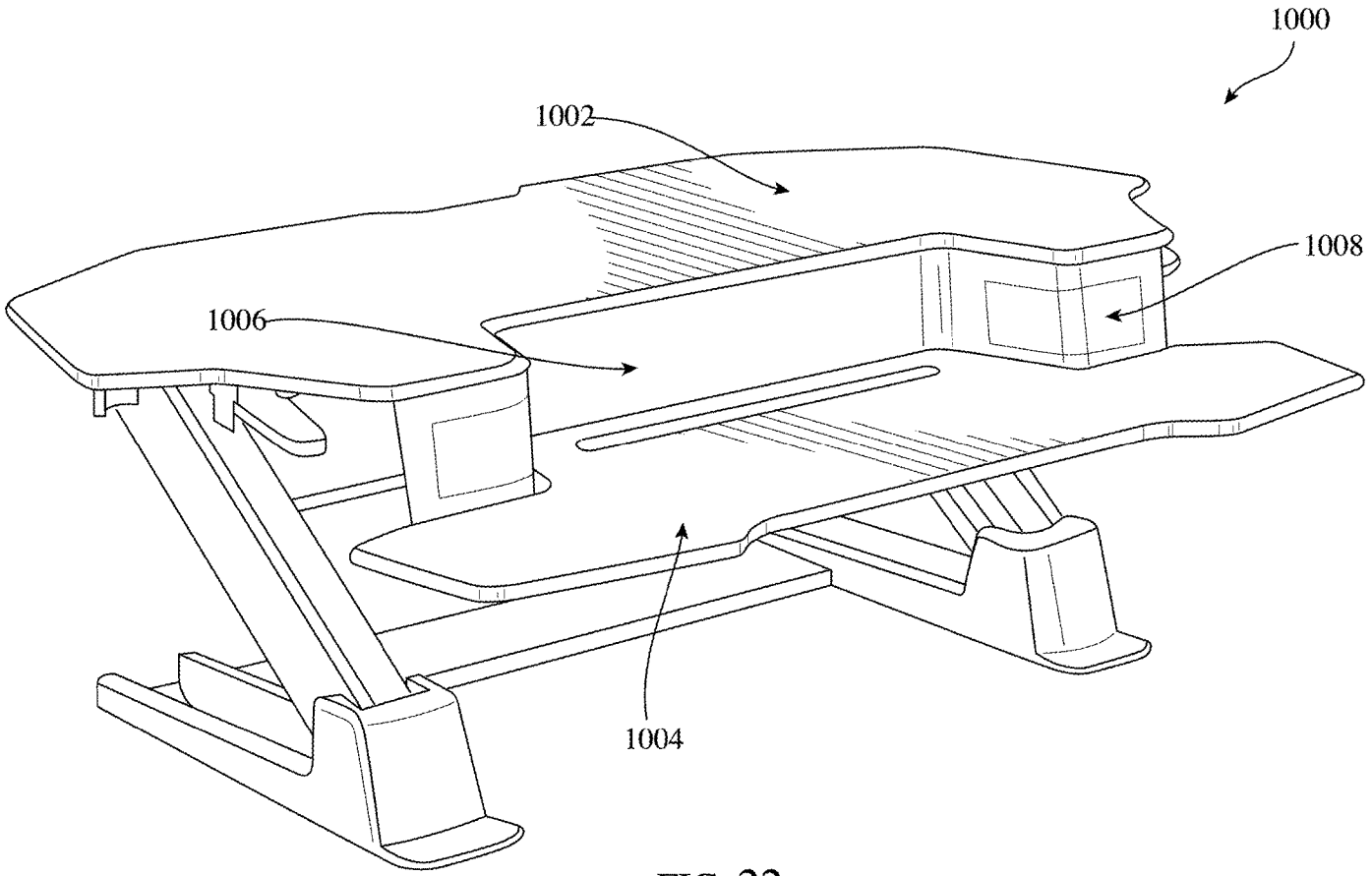

With reference to FIG. 21, a height adjustment platform with stopper embodiment 900 is illustrated. As shown, a second working table 904 may be positioned beneath the first working table 902 and may be attached to the first working table 902 via the stopper 906. With reference to FIG. 22, another height adjustment platform with stopper embodiment 1000 is illustrated. Similarly, a second working table 1004 may be positioned beneath the first working table 1002 and may be attached to the first working table 1002 via the stopper 1006. In each embodiment (but with reference to the embodiment 900), the stopper 906 may be positioned at an inner (i.e., back or rear) edge of the second working table 904 and may be further configured to prevent translation of objects supported by the second working table 904. As shown in the embodiment 900, with a similar configuration in the embodiment 1000, the stopper 906 may be, in some embodiments, configured to support and position the second working table 904 substantially parallel with respect to the first working table 902. Additionally, the attachment of the second working table 904 to the first working table 902 via the stopper 906 may be such that the second working table 904 is substantially perpendicular with respect to the stopper 906. As shown in FIGS. 21-22, the stoppers 906 and 1006 may be positioned (e.g., extend) along any length of the second working table 904 and 1004.

As shown in the embodiment 900 of FIG. 21, the stopper 906 may also taper (e.g., recede, narrow, etc.) such that a portion of the stopper 906 contacts only the second working table 904. Said another way, the stopper 906 may be positioned along an inner edge of the working table 904 and may match the contours defined by the first working table 902 and the second working table 904, but a portion of the stopper 906 may form an extension 908 that only contacts the inner edge of the second working table 904. With reference to the embodiment 1000 of FIG. 22, in some embodiments, the stopper 1006 may also define one or more removable panels 1008 (e.g., inserts, slats, or the like). These panels 1008 may be removable to allow for various cords, connections, attachment elements, or the like to be accessible to a user at the second working table 1004.

Figure 23:
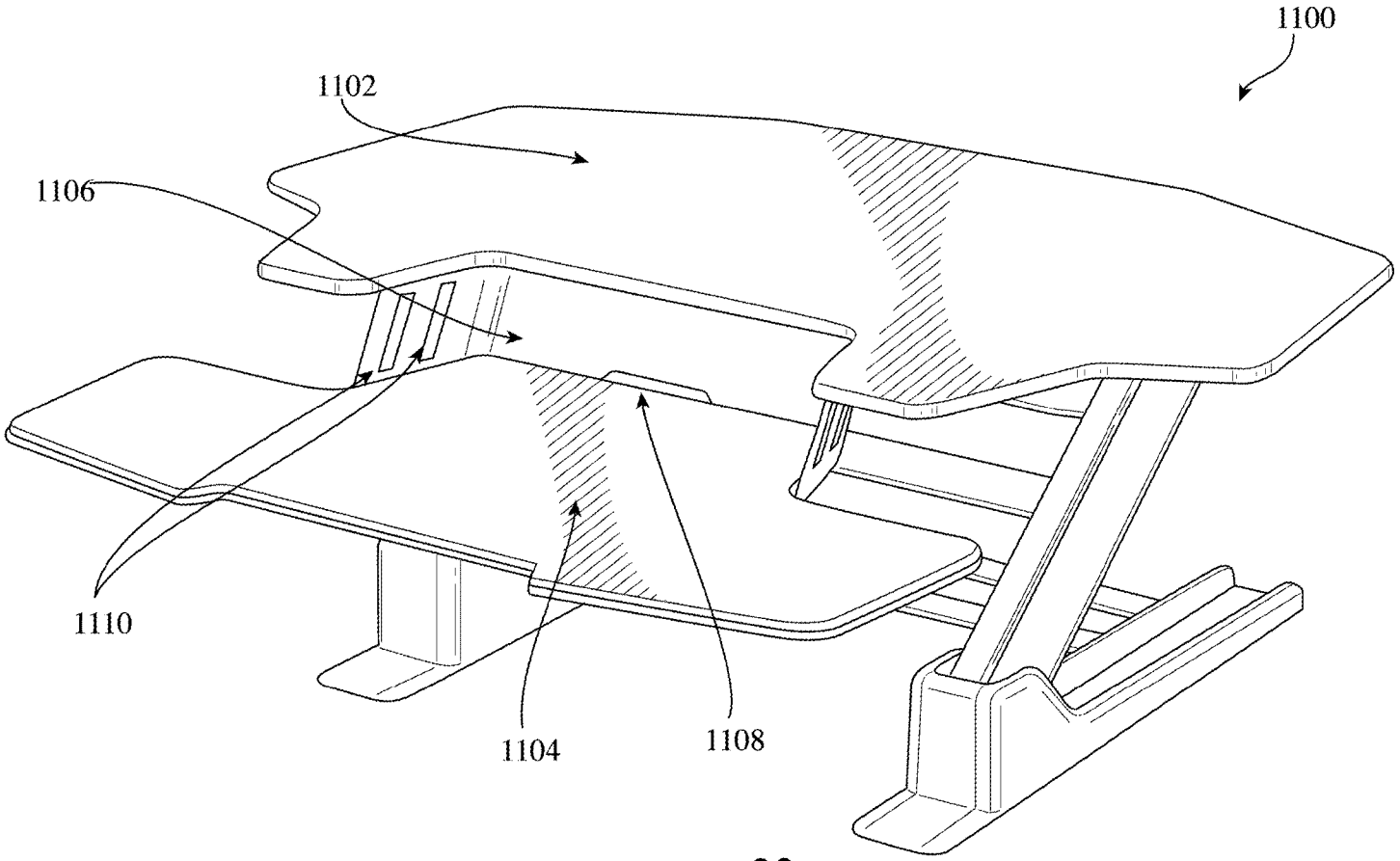
Figure 24:
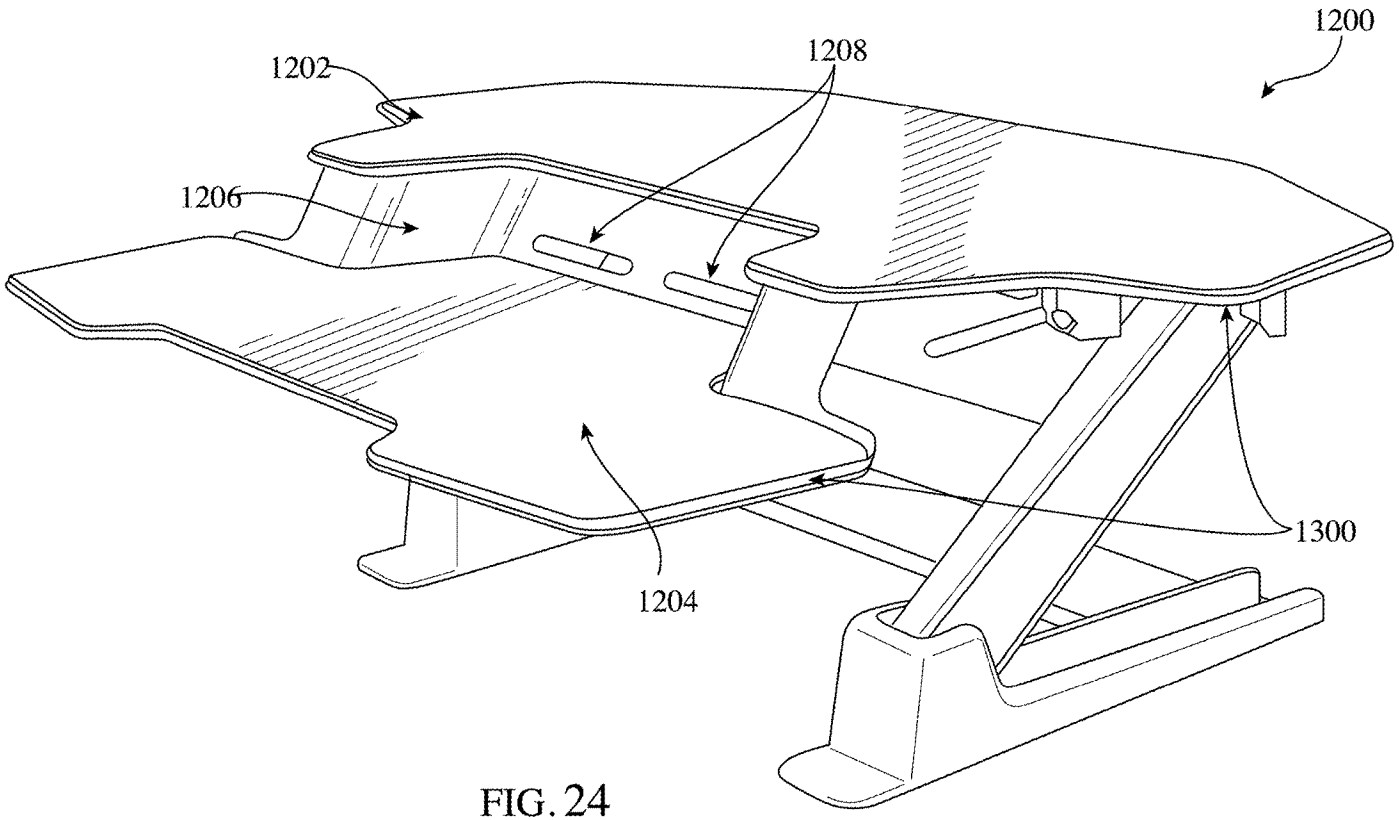

With reference to FIG. 23, a height adjustment platform with stopper embodiment 1100 is illustrated. As shown, a second working table 1104 may be positioned beneath the first working table 1102 and may be attached to the first working table 1102 via the stopper 1106. With reference to FIG. 24, another height adjustment platform with stopper embodiment 1200 is illustrated. Similarly, a second working table 1204 may be positioned beneath the first working table 1202 and may be attached to the first working table 1202 via the stopper 1206. In each embodiment (but with reference to the embodiment 1100), the stopper 1106 may be positioned at an inner edge of the second working table 1104 and may be further configured to prevent translation of objects supported by the second working table 1104. As shown in the embodiment 1100, with a similar configuration in the embodiment 1200, the stopper 1106 may be, in some embodiments, configured to position the second working table 1104 substantially parallel with respect to the first working table 1102 and may be configured to extend the second working table 1104 away from the first working table 1102. Said another way, the attachment of the second working table 1104 to the first working table 1102 via the stopper 1106 may be such that the angle between the second working table 1104 is and the stopper 1106 is greater than 90° (e.g., an obtuse angle between the second working table 1104 and the stopper 1106). As shown in FIGS. 23-24, the stoppers 1106 and 1206 may be positioned (e.g., extend) along any length of the second working table 1104 and 1204. As shown in the embodiments 1100 and 1200, the second working table 1104 and 1204 may be extend outward from the first working table 1102 and 1202 such that items (e.g., keyboards, tablets, etc.) may be easily accessed by a user.

In any of the above described embodiments, the stoppers (e.g., 906, 1006, 1106, and 1206) may define one or more recesses, slots, openings, or the like. These openings may operate to allow electronic devices supported by the second working table to be connected (e.g., via cables, connectors, etc. received by the openings) to other electronic devices, electrical outlets, or the like. Furthermore, the openings of any of these embodiments may also be configured to increase airflow experienced by the second working table. Such airflow may, in some embodiments, promote convective cooling of devices supported by the second working table. Still further, the present disclosure contemplates that various configurations and orientations of slots, extensions, openings, and the like may be used to increase an aesthetic appeal of the embodiments described herein.

By way of example, with reference to FIG. 21, in some embodiments the stopper 906 may include one or more slots 910 defined by a vertical portion of the stopper 906 attaching the second working table 904 to the first working table 902. In some embodiments, these slots 910 may be positioned parallel to the second working table 904 and may extend a portion of a length of the inner edge of the second working table 904. The slots 910 may be configured to receive one or more connectors, chargers, plugins, cables, or the like such that objects supported by the second working station may connect with said connectors, charger, etc. (e.g., a power cable may reach a laptop supported by the second working table.)

With reference to FIG. 23, in some embodiments the stopper 1106 may include an opening 1108 at an inner edge of the second working table 1104. Said another way, the opening 1108 may be positioned such that a portion of an inner edge of the second working table does not contact the stopper 1106. As shown in FIG. 23, the opening 1108 may be dimensioned to define a trapezoid shape configured to receive one or more connectors, chargers, cables, or the like therethrough. Although illustrated with a trapezoidal opening 1108, the present disclosure contemplates that any shape may be used to accommodate devices and connectors of any size. Additionally, as shown in FIG. 23, the stopper 1106 may further include slots 1110 defined by one or more contoured portions of the stopper 1106. As described above, in some embodiments the stopper 1106 may be configured to match the contour of the second working table 1104. In this regard, one or more portions of the stopper 1106 may be positioned such that these contoured portions are substantially perpendicular with respect to the inner edge of the second working table 1104. As shown in FIG. 23, these slots 1110 may provide access (e.g., for cables, connectors, etc.) to one or more sides of the second working table 1104.

With reference to FIG. 24, in some embodiments the stopper 1206 may include one or more slots 1208 disposed parallel to the second working table 1204 and further positioned in line with each respective slot 1208. By way of example, a portion of the stopper 1206 that contacts an inner edge of the second working table 1204 may define two congruent slots 1208 which are substantially parallel with respect to the second working table 1204 and are each located in-line.

Although described above as attaching the second working table to the first working table, the stopper of any of the embodiments 900, 1000, 1100, and 1200 may be configured to prevent any items (e.g., cellphones, keyboards, pencils, etc.) from rolling, sliding, or otherwise falling from the second working table. Furthermore, although illustrated in the present figures as positioned along an inner edge of the second working table, the present disclosure contemplates that any stopper may also be positioned at any location of the second working table to prevent translation of objects supported thereon. Still further, the stopper and the second working table may, in some embodiments, be formed of a single member with the first working table. Said another way, the second working table may be integral to the first working table.

As illustrated in FIGS. 21 and 24, in some embodiments, an exterior edge of the first or second working tables (e.g., the first working table 902 and the second working table 904 in FIG. 21) may also include a decorative edge member 1300. With reference to FIG. 21, the first working table 902 and/or the second working table 904 may each define a top surface and a bottom surface. Each working table may be configured such that an exterior edge of the working table is indented (e.g., notched, recessed, or the like) to receive a corresponding decorative edge member 1300 wedged in said indentation. As shown, the decorative edge member 1300 may be received between the top and bottom surfaces of its respective working table and may be configured to extend beyond the exterior edge of the working table. In some embodiments, the decorative edge member 1300 may also include a contrasting color with respect to other elements of the height adjustment platform 100. Although described in reference to the embodiments illustrated in FIGS. 21 and 24, the present disclosure contemplates that any working table or surface described herein may be configured to receive a decorative edge member along at least a portion of an exterior edge of said working table or surface. Furthermore, the present disclosure contemplates that any or all of the exterior edge of any working table may receive a decorative edge member 1300. Said another way, the working tables described herein may include a decorative edge member 1300 that only extends along only a portion of the exterior edge in any design or configuration.

Figure 13:
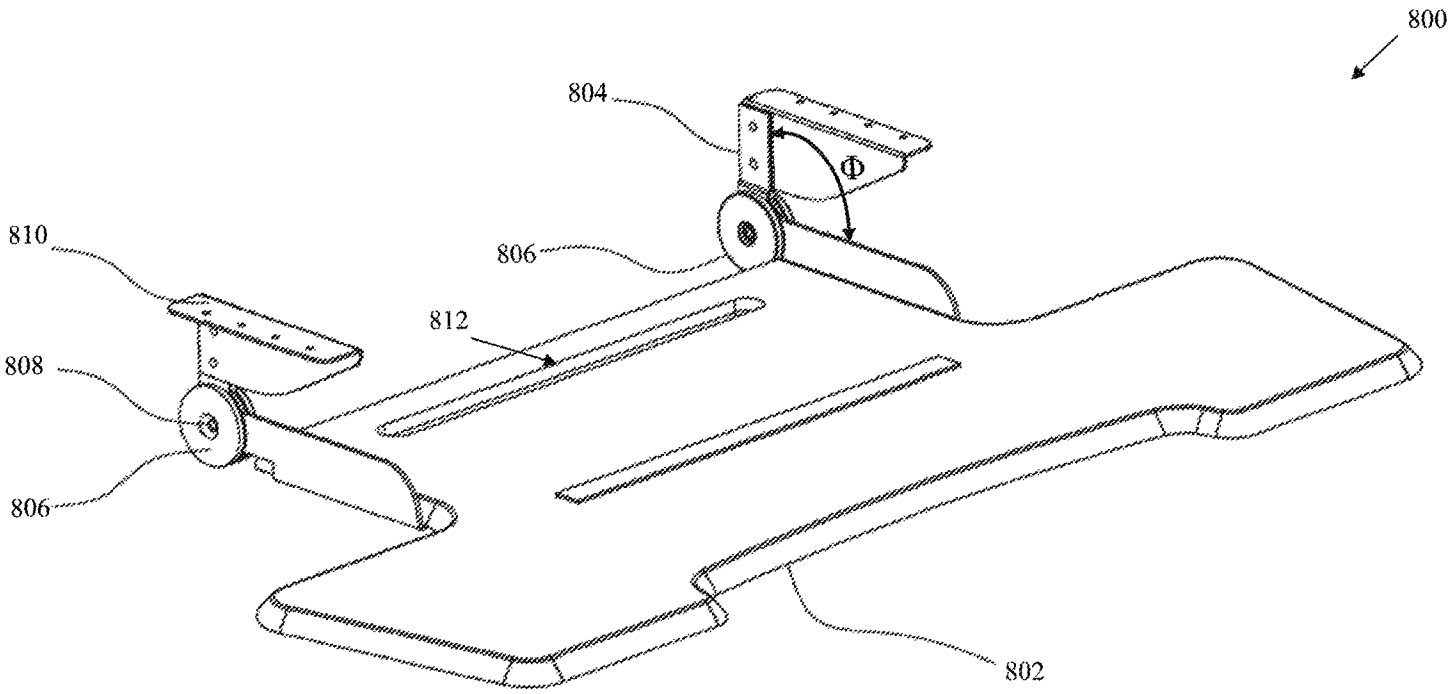
FIG. 13 illustrates an isometric view of an adjustable tray system, in accordance with some embodiments discussed herein.

With reference to FIG. 13, an adjustable tray system 800 is illustrated. The adjustable tray system 800 may include a working table 802, a support member 804, and an adjustment mechanism 806. As is evident in FIG. 13, the working table 802 may be configured to support various objects (e.g., electronics, keyboards, and the like) for access by a user associated with the adjustable tray system 800. The working table 802 may be attached to a supporting structure (e.g., a platform, desk, adjustable desk, and the like) via support member(s) 804. In some embodiments, the support member(s) may further include a bracket 810 configured to secure the support member 804 with a supporting structure. Said another way, and evident in FIGS. 17-20 described hereinafter, the adjustable tray system 800 (e.g., an adjustable keyboard tray) may be attached to the underside of a working table of a height adjustment platform (e.g., height adjustable desk) via the support member(s) 804. Although described hereinafter with reference to a height adjustment platform as the supporting structure, the present disclosure contemplates that the adjustable tray system 800 may be attached to any supporting structure with or without height adjustment. Similarly, the present disclosure further contemplates that the adjustable tray system 800 may be permanently affixed to a supporting structure, in some embodiments, or may be temporarily attached (e.g., removable) to a supporting structure in other embodiments.

The adjustable tray system 800 may further include at least one adjustment mechanism 806 configured to couple the working table 802 with the support member 804. As shown in FIG. 13, the connection between the working table 802 and the support member 804 may be such that an angle Φ is formed between these elements. The adjustment mechanism 806 may be configured to allow the working table 802 to be tilted (e.g., angular adjustment) about a pivot point 808 of the adjustment mechanism 806. As would be evident to one of ordinary skill in the art in light of the present disclosure, the angular adjustment of the working table 802 may be such that the angle Φ decreases as the working table 802 pivots upward. As shown in FIG. 13, the adjustable tray system 800 may be configured to be positioned in a resting position such that the working table 802 is substantially perpendicular with respect to the support member(s) 804 (e.g., angle Φ is approximately 90°).

Figure 14:
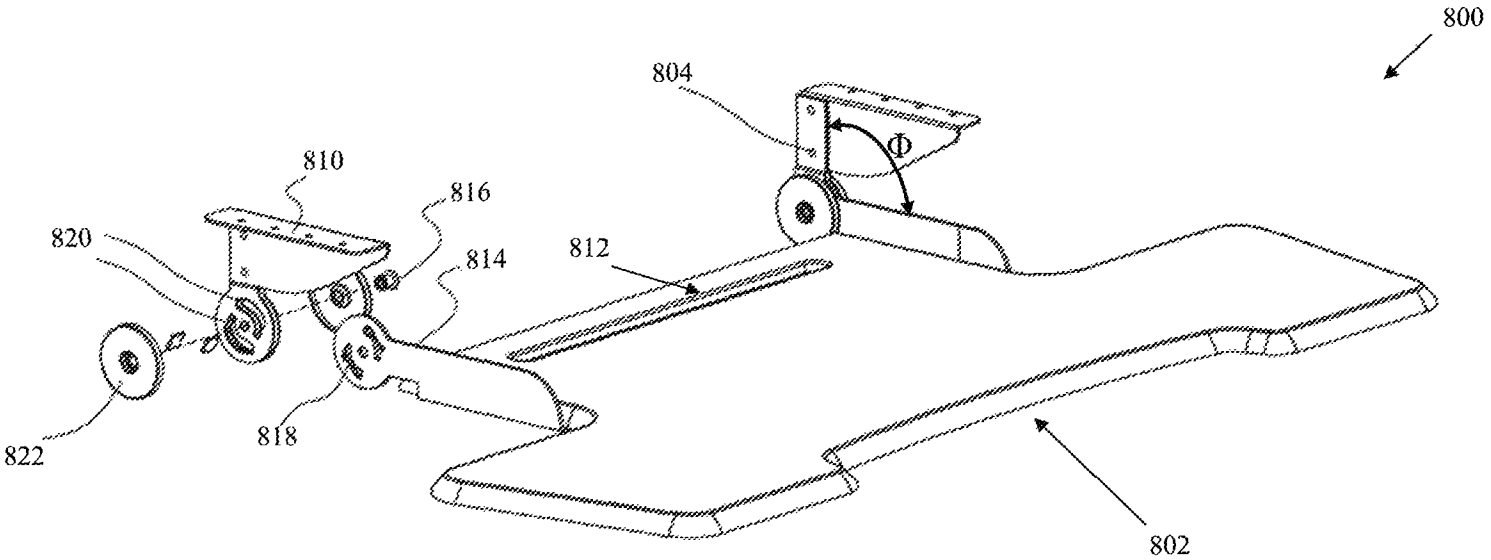
FIG. 14 illustrates an exploded view of an adjustment mechanism of the adjustable tray system of FIG. 13.

With reference to FIG. 14, an exploded view of the adjustment mechanism 806 of the adjustable tray system 800 of FIG. 13 is illustrated. As illustrated, the adjustment mechanism 806 may include an extension 814, a ratcheting element 820, and a rotational shaft 816. The extension 814 may be attached to the working table 802 and may be configured to be received by the ratcheting element 820. Similarly, the ratcheting element 820 may be attached to the support member 804 and may be configured to receive the extension 814. The extension 814 may include a spring-loaded pin assembly 818 described in detail hereinafter. The ratcheting element 820 may similarly define one or more teeth which may be engaged by the spring-loaded pin assembly 818 when the extension 814 is received by the ratcheting element 820. As would be understood by one of ordinary skill in the art in light of the present disclosure, the extension 814 attached to the working table 802 may be aligned within the ratcheting element 820 and secured therein via a rotational shaft 816. This connection may secure the extension 814 within the ratcheting element 820 such that the extension 814, and by attachment the working table 802, may pivot about the rotational shaft 816.

As described generally above, the adjustment mechanism 806 may operate as a ratchet (e.g., or similar angular adjustment which allows locking in various angular positions) such that, when the working table 802 is adjusted by a user (e.g., via an upward force applied to the working table), the spring-loaded pin assembly 818 may move to engage one or more teeth defined by the ratcheting element 820. As shown in detail with reference to FIGS. 19-20 below, the spring-loaded pin assembly may be, upon rotation of the working table 802 with respect to the support member(s) 804, positioned at various angular positions (e.g., various angle Φ values). Said another way, a user may rotate the working table 802 (e.g., tilt upward) such that the angle Φ decreases. The spring-loaded pin assembly 818 may disengage a current tooth defined by the ratcheting element 820, and, upon rotation, may engage a subsequent tooth of the ratcheting element 820 such that the working table 802 leaves a resting position as described above and is located at a tilted position. Although illustrated herein with two support members 804 each coupled with the working table 802 via an adjustment mechanism 806, the present disclosure contemplates that any number of adjustment mechanisms 806 or other support members 804 may be used with the embodiments described herein. In some embodiments, the adjustment mechanism 806, as shown in the exploded view of FIG. 14, may employ various endcaps 822, washers, and the like for enclosing and protecting the operable elements of the adjustment mechanism 806.

Figure 16:
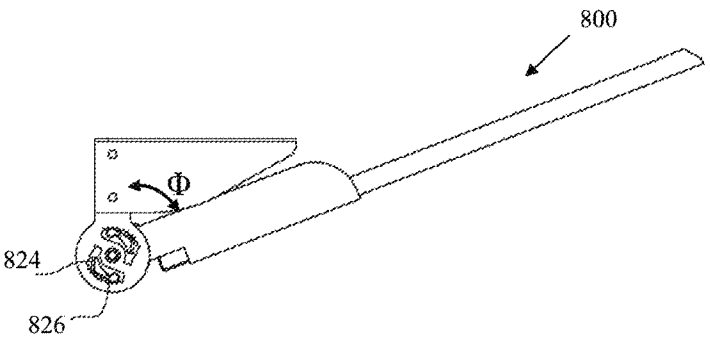
FIGS. 15-16 illustrate side views of the adjustable tray system of FIG. 13 in a resting position and a tilted position, respectively.
Figure 15:
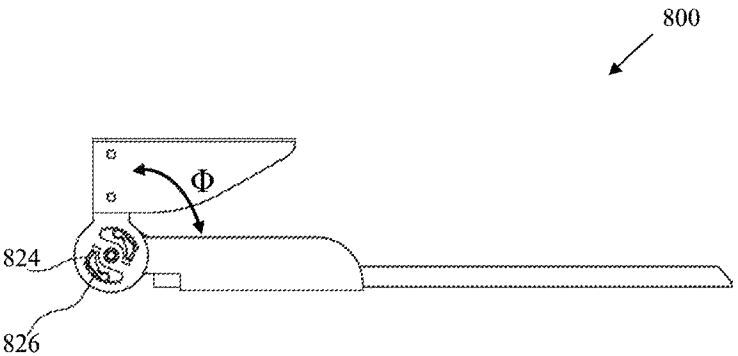

With reference to FIGS. 15-16, the adjustable tray system 800 is illustrated in a resting position and a tilted position, respectively. Shown more clearly herein, the spring-loaded pin assembly 818 may include a spring 824 and a pin 826. As described above with reference to the angular adjustment of the working table 802, the spring 824 and pin 826 may operate to ratchet with the ratcheting element 820 such that the working table 802 may tilt between a resting position as shown in FIG. 15 where the angle Φ is approximately 90° to a tilted position as shown in FIG. 16 where the angle Φ is less than 90°.

With reference to FIGS. 17-20, the adjustable tray assembly 800 is shown in conjunction with a height adjustment platform (e.g., height adjustment platform 100 in FIGS. 1-5). As described above, the working table 802 may be positioned below a working table, top surface, top table, or the like defined by a height adjustment platform 100. As described herein reference is made to the height adjustment platform embodiment 100 of the present disclosure. However, the adjustable tray system 802 of the present disclosure may be equally used in conjunction with any of the height adjustment platform embodiments described herein (e.g., height adjustment platforms 100, 200, 300, 400, 500, 600, or 700).

As shown in FIGS. 13-14 and 17-18, in some embodiments, the adjustable tray system 800 may further include a recess 812 defined by a top surface of the working table 802. In some embodiments, as shown, the recess 812 may be positioned substantially perpendicular with respect to the support member 804 and configured to position a device received therein. Said another way, the working table 802 may define a recess 812 such that a device (e.g., smartphone, tablet, etc.) disposed on the working table 802 in the recess 812 may be positioned to substantially face the user, and may also lean and/or rest against another working table above working table 802, such as or similar to the illustrated configuration of FIG. 22. As described herein, although positioned near an inner (i.e., back or rear) edge of the working table 802, the present disclosure contemplates that one or more recess 812 may be positioned at any location on the working table 802, and may be positioned at any angle or orientation. For example, a recess may be parallel to and corresponding with edges of a u-shaped cut-out or recess on an upper working table, such as to allow a device to lean and/or rest against a left and/or right side edge of the u-shaped recess. Furthermore, a recess in a working table may have any number of various shapes to accommodate electronic devices, such as the linear rounded concave recess 812 illustrated or similar concave recess, and may have any number of various sizes to accommodate electronic devices, such as sized in depth and width to accommodate smartphones and tablets, or, for example, with a wider and/or deeper size to accommodate thicker laptops and Chromebooks that fold to operate in a tablet mode. A recess 812 may possess any depth up to but not exceeding the thickness of the working table 802.

Figure 17:
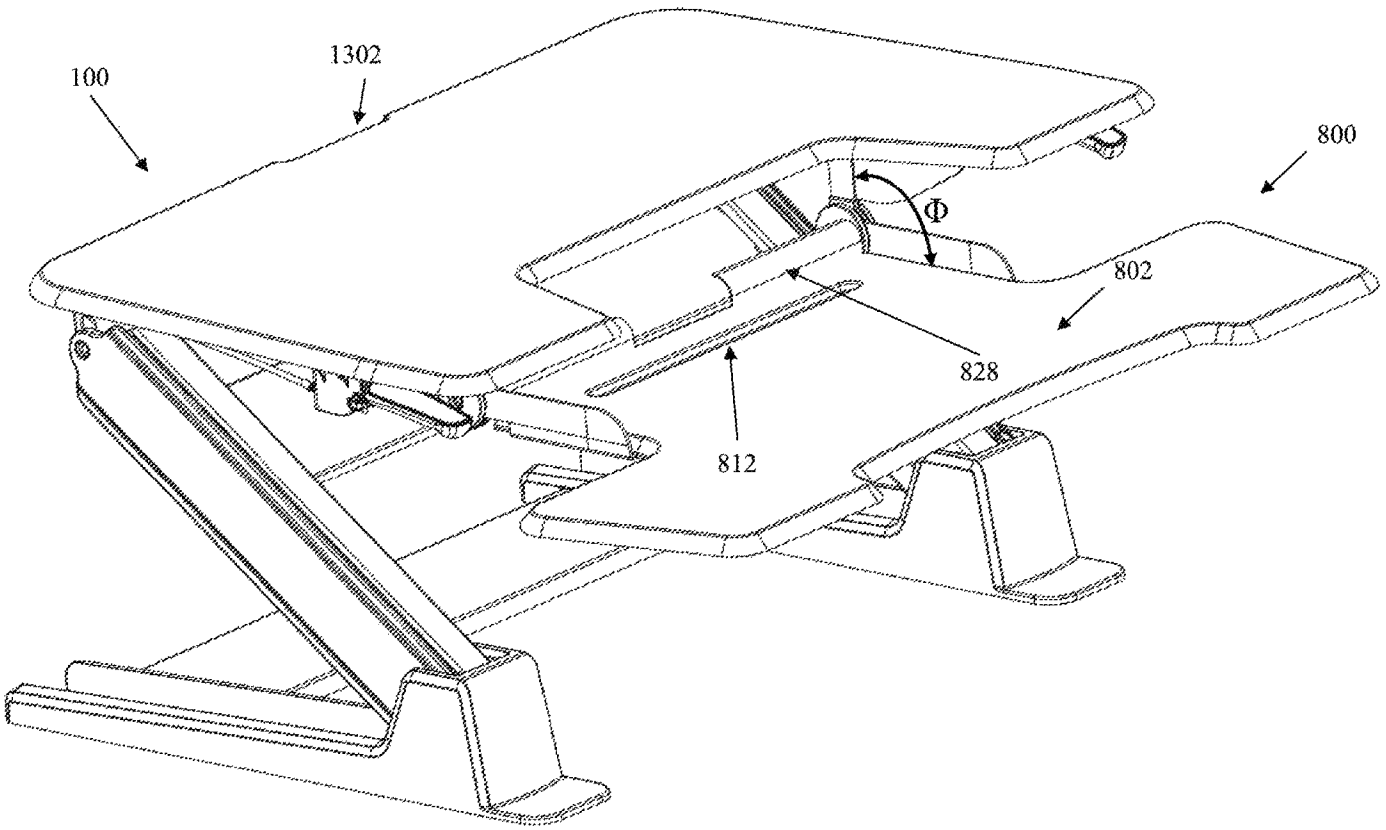
FIG. 17 illustrates an isometric view of the adjustable tray system of FIG. 13 in conjunction with the first embodiment of a height adjustment platform of FIG. 1 in a resting position.

In some embodiments, the adjustable tray system 800 may also include a stopper 828. The stopper 828 may be positioned at an inner (i.e., back or rear) edge of the working table 802 and may be further configured to prevent translation of objects supported by the working table 802. In particular, in an instance in which the working table 802 pivots from a resting position (e.g., as shown in FIG. 15) to a tilted position (e.g., as shown in FIG. 16) the stopper 828 may function to prevent any items (e.g., cellphones, keyboards, pencils, etc.) from rolling, sliding, or otherwise falling from the inner edge of the working table 802. Although illustrated in the present figures as positioned along an inner edge of the working table 802, the present disclosure contemplates that the stopper 828 may also be positioned at any location of the working table 802 to prevent translation of objects supported thereon. Furthermore, the present disclosure contemplates that the stopper 828 may extend continually along the entire length of all or a portion of an inner edge of the working table 802 (not shown) or may be split such that only a portion of the inner edge of the working table defines a stopper 828 (e.g., to accommodate wires, connectors, or the like which may be used to connect to items supported by the working table 802). As shown in FIG. 17, the stopper 828 may, in some embodiments, be defined as an arced member (e.g., plane or other element with a curved trajectory) which projects away from the working table 802. Although illustrated as an arced member, the present disclosure contemplates that the stopper 828 may have any number of various shapes to prevent electronic devices of all sizes from falling from the inner edge of the working table 802. For example, a stopper 828 with a larger size may prevent thicker laptops and Chromebooks from falling due to increase rigidity of the stopper 828. A stopper 828 may possess any height or shape so long as adjustment of the second working table 802 is allowed and items supported by the working table 802 may be prevented from falling.

Figure 18:
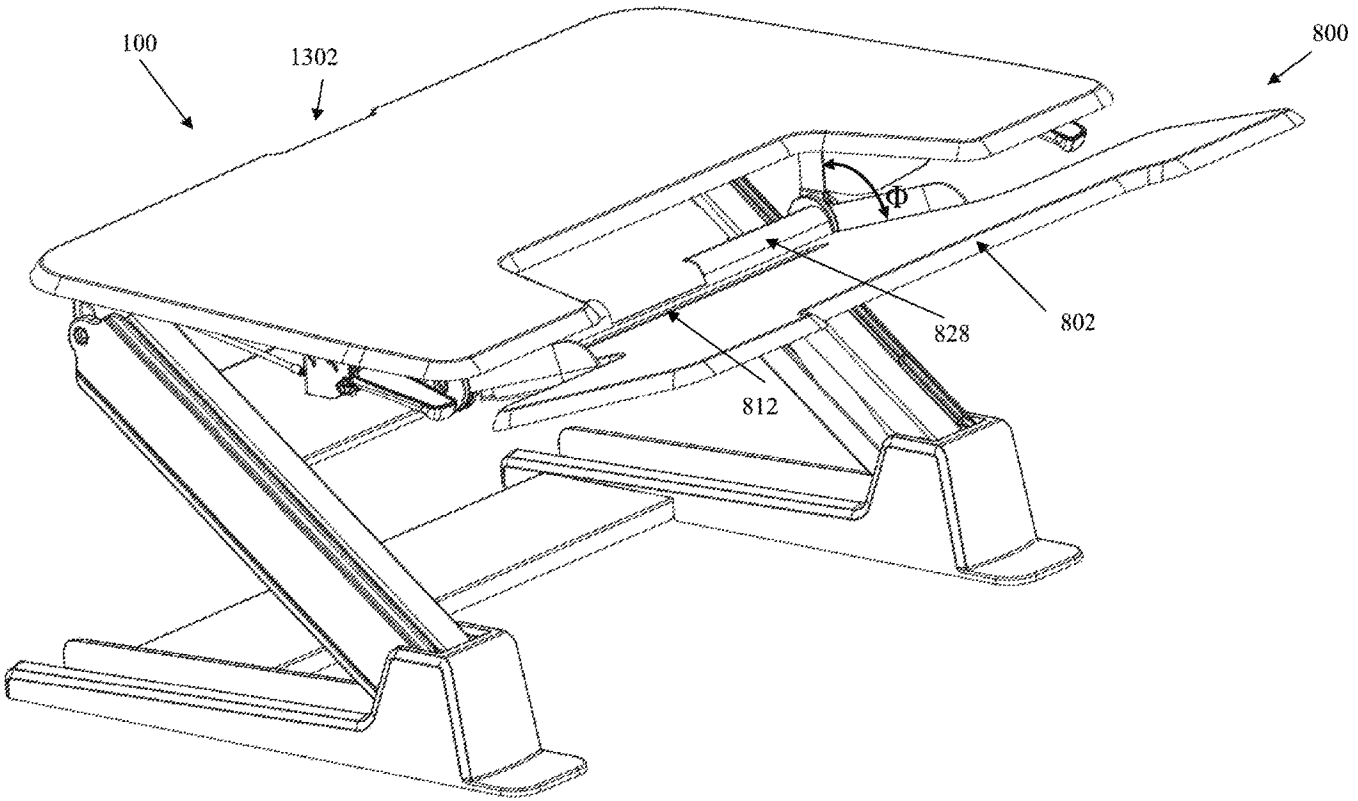
FIG. 18 illustrates an isometric view of the adjustable tray system of FIG. 13 in conjunction with the first embodiment of a height adjustment platform of FIG. 1 in a tilted position.
Figure 25:
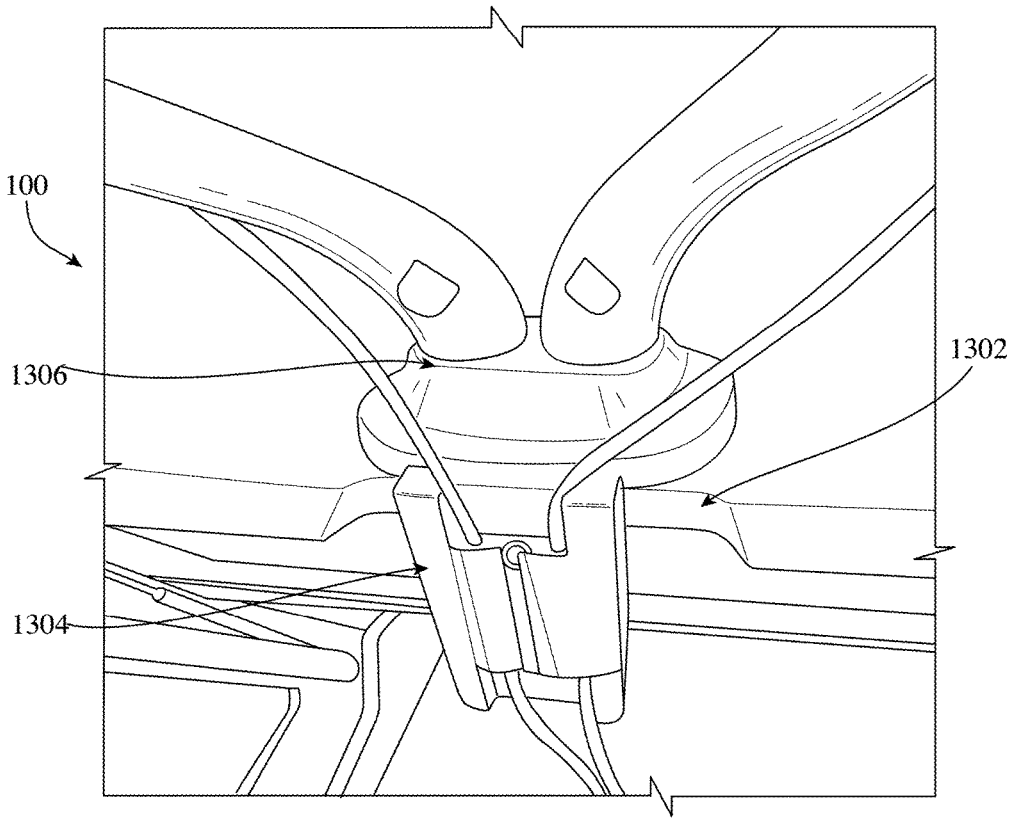
FIG. 25 illustrates a rear perspective view of a height adjustment platform with notch, in accordance with some embodiments discussed herein.

With continued reference to FIGS. 17-18, in some embodiments, the first working table of the height adjustment platform 100 may define a notch 1302. As shown in more detail in the rear perspective view of FIG. 25, the notch 1302 may be located along at least a portion of an exterior edge of the first working table. As shown, the notch 1302 may define a cut-away, depression, or other indentation such that at least a portion of a width of the exterior edge of the first working table narrows along a length of the first working table. The notch 1302 may further be configured to accommodate one or more clamps 1304 (e.g., mounts, brackets, or the like) such that when a clamp 1304 is received by the notch 1302, the clamp 1304 is flush with respect to the exterior edge of the first working table. Said another way, the notch 1302 may be configured to support a clamp 1304 to prevent extension of the clamp 1304 beyond the exterior edge of the first working table. The clamp 1304 received by the notch 1302 may be configured to support one or more support stands 1306. As shown, the support stand 1306 may be configured to hold or otherwise support one or more monitors. While described with reference to one or more monitors, the present disclosure contemplates that the notch 1302, clamp 1304, and support stand 1306 may be dimensioned or otherwise configured to accommodate any device (e.g., television, tablet, or the like) such that the clamp 1304 remains flush with the exterior edge of the first working table. Additionally, although shown and described with reference to only a single notch 1302, the present disclosure also contemplates that any number of notches 1302 of any shape or size may be utilized by the first working table to support any number of clamps 1304.

Figure 19:
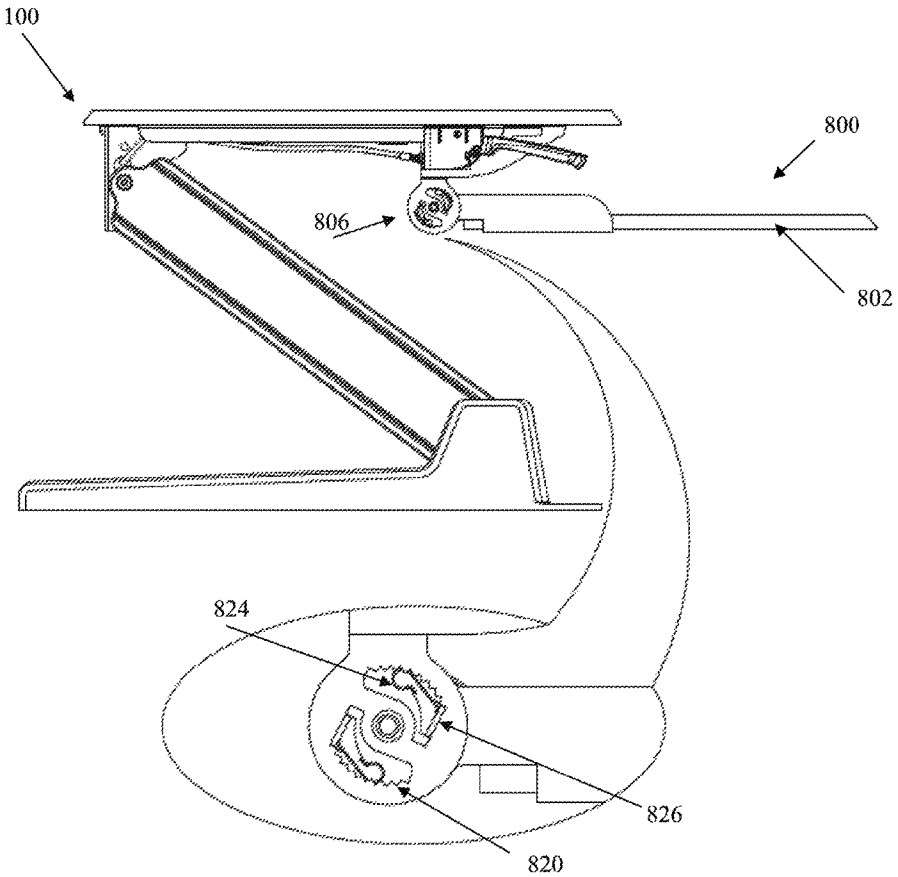
FIG. 19 illustrates a side view of the configuration of FIG. 17 with an enlarged portion of the adjustment mechanism.
Figure 20:
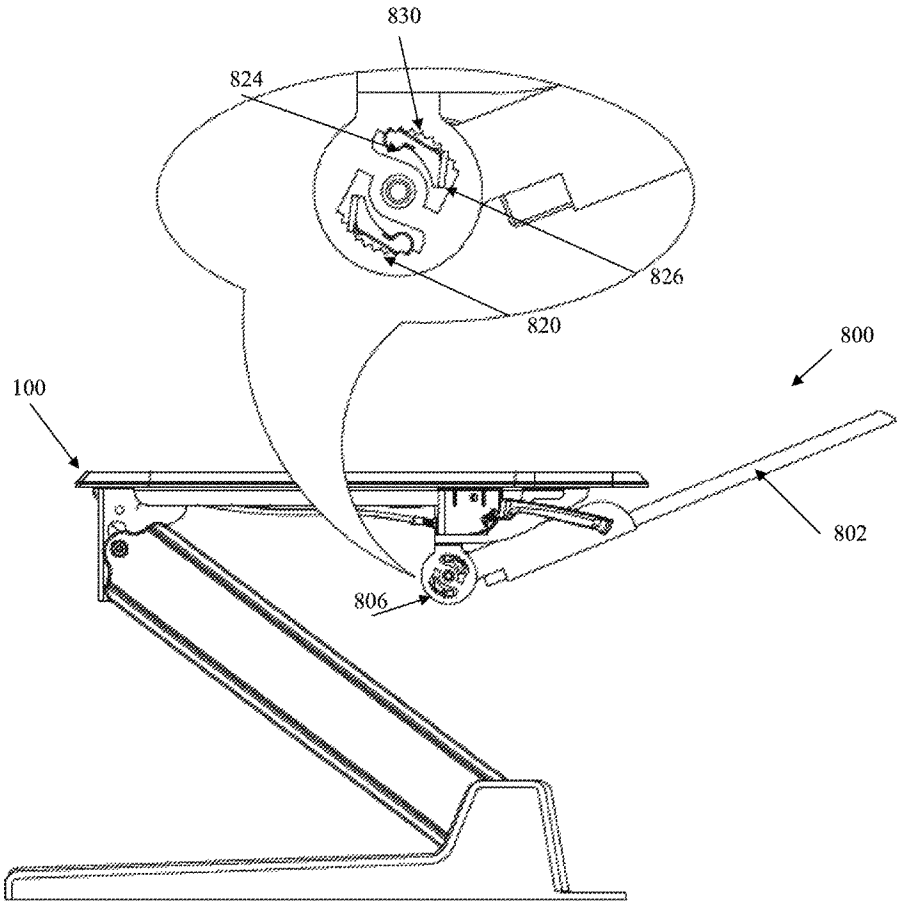
FIG. 20 illustrates a side view of the configuration of FIG. 18 with an enlarged portion of the adjustment mechanism.

With reference to FIGS. 19-20, side views of the adjustable tray system 800 are illustrated with an enlarged portion of the adjustment mechanism 806 in a resting position and tilted position, respectively. As shown and described above, the adjustment mechanism 806 may include a spring 824, a pin 826, and a ratcheting element 820. Additionally, in some embodiments, the ratcheting element 820 may further define a reset position 830. The reset position 830 may include any portion of the ratcheting element 820 such that when the spring-loaded pin assembly 818 (e.g., spring 824 and pin 826) rotates beyond the reset position 830, the spring 824 is compressed such that the pin 826 cannot engage any tooth of the ratcheting element 820. In such an instance, the working table 802 may then be lowered from a tilted position to a resting position.

The embodiments shown and described above are only examples. Many details are often found in the art, such as features of control system and control method for vehicle anti-theft. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. Therefore, those of ordinary skill in the art can make various modifications to the embodiments without departing from the scope of the disclosure, as defined by the appended claims.

What is claimed is:

1. An adjustable tray system comprising:

a working table;

a support member, wherein the support member is configured to attach the working table with a supporting structure; and at least one adjustment mechanism disposed at a juncture between the working table and the support member, wherein the juncture is in direct contact with the working table, wherein the at least one adjustment mechanism is configured to couple the working table with the support member such that an angle Φ is formed between the support member and the working table, wherein the at least one adjustment mechanism is configured to allow angular adjustment of the working table relative to the support member such that the working table pivots about the juncture.

2. The adjustable tray system according to claim 1, wherein the at least one adjustment mechanism further comprises:

a ratcheting element attached to the support member;

an extension attached to the working table and configured to be received by the ratcheting element; and a rotational shaft configured to position and secure the extension within the ratcheting element such that the extension and working table pivot about the rotational shaft.

3. The adjustable tray system according to claim 2, wherein the extension further comprises a spring-loaded pin and the ratcheting element further comprises a rack defining one or more teeth such that the working table and extension may pivot about the rotational shaft to be positioned at one or more angular positions via the spring-loaded pin engaging the one or more teeth defined by the ratcheting element.

4. The adjustable tray system according to claim 3, wherein the ratcheting element defines a reset position such that in an instance in which the spring-loaded pin of the extension rotates to the reset position, the spring-loaded pin may be compressed such that the extension and working table may be positioned at a resting position where the angle Φ is formed between the support member and the working table.

5. The adjustable tray system according to claim 1, wherein the working table further comprises a recess defined by a top surface of the working table.

6. The adjustable tray system according to claim 5, wherein the recess is positioned perpendicular with respect to the support member and configured to position a device received therein.

7. The adjustable tray according to claim 1, wherein the working table further comprises a stopper positioned at an inner edge of the working table and configured to prevent translation of objects supported by the working table in an instance in which the working table pivots about a rotation point of the adjustment mechanism.

8. The adjustable tray according to claim 1, wherein the working table further comprises a decorative edge member wedged between a top surface and a bottom surface of the working table along at least a portion of an exterior edge of the working table.

9. A height adjustment platform comprising:

a first working table;

a bottom bracket;

at least one lifting arm;

at least one driving mechanism configured to drive and lock the lifting arm;

at least one control switch configured to control the driving mechanism, wherein two opposite ends of the lifting arms are separately coupled to the first working table and the bottom bracket, the driving mechanism is coupled to the lifting arm, and the angle is formed between the driving mechanism and the lifting arm, a second working table positioned below the first working table;

a support member, wherein the support member is configured to attach the second working table with the first working table; and at least one adjustment mechanism disposed at a juncture between the working table and the support member, wherein the juncture is in direct contact with the working table, wherein the at least one adjustment mechanism is configured to couple the second working table with the support member such that an angle Φ is formed between the support member and the second working table, wherein the at least one adjustment mechanism is configured to allow angular adjustment of the second working table such that the second working table pivots about the juncture.

10. The height adjustment platform according to claim 9, wherein the at least one adjustment mechanism further comprises:

a ratcheting element attached to the support member;

an extension attached to the second working table and configured to be received by the ratcheting element; and a rotational shaft configured to position and secure the extension within the ratcheting element such that the extension and second working table pivot about the rotational shaft.

11. The height adjustment platform according to claim 10, wherein the extension further comprises a spring-loaded pin and the ratcheting element further comprises a rack defining one or more teeth such that the second working table and extension may pivot about the rotational shaft to be positioned at one or more angular positions via the spring-loaded pin engaging the one or more teeth defined by the ratcheting element.

12. The height adjustment platform according to claim 11, wherein the ratcheting element defines a reset position such that in an instance in which the spring-loaded pin of the extension rotates to the reset position, the spring-loaded pin may be compressed such that the extension and second working table may be positioned at a resting position where the angle D is formed between the support member and the second working table.

13. The height adjustment platform according to claim 10, wherein the second working table further comprises a recess defined by a top surface of the second working table and configured to position a device received therein.

14. The height adjustment platform according to claim 10, wherein the lifting arm is rotatably coupled to the first working table and the bottom bracket; when in use, both of the lifting arm and the bottom bracket rotate an angle ranging from 0 to 60 degrees.

15. The height adjustment platform according to claim 10, further comprising two lifting arms and at least one connecting rod, wherein the two lifting arms are positioned on opposite sides between the first working table and the bottom bracket, the connecting rod is positioned between the two lifting arms, and two opposite ends of the connecting rod are coupled to the two lifting arms.

16. The height adjustment platform according to claim 9, wherein at least one of the first working table and the second working table further comprises a decorative edge member wedged between a top surface and a bottom surface of the first working table or the second working table, respectively, where the decorative edge member is further positioned along at least a portion of an exterior edge of the first working table or the second working table, respectively.

17. The height adjustment platform according to claim 9, wherein the second working table further comprises a stopper positioned at an inner edge of the second working table and configured to prevent translation of objects supported by the second working table in an instance in which the second working table pivots about a rotation point of the adjustment mechanism.

18. The height adjustment platform according to claim 9, wherein the first working table further comprises a notch located along at least a portion of an exterior edge of the first working table.

19. A height adjustment platform comprising:

a first working table;

a bottom bracket;

at least one lifting arm;

a first elongate portion and a second elongate portion, wherein the first and second elongate portions have a same shape and are displaced parallel to each other;

a first joint device and a second joint device, wherein the first and second joint devices have a same shape and are displaced parallel to each other and are perpendicular to the first working table, wherein opposite ends of each of the first elongate portion and the second elongate portion are coupled to the first joint device and the second joint device, respectively;

wherein the first and second elongate portions and the first and second joint devices are configured to move in a same plane during motion of the table height adjustment;

at least one driving mechanism configured to drive and lock the lifting arm;

at least one control switch configured to control the driving mechanism, wherein two opposite ends of the lifting arms are separately coupled to the first working table and the bottom bracket, the driving mechanism is coupled to the lifting arm, and the angle $\theta$ is formed between the driving mechanism and the lifting arm, a second working table positioned below the first working table; and a stopper, wherein the stopper is configured to attach the second working table with the first working table continuously along an inner edge of the second working table.

20. The height adjustment platform according to claim 19, wherein the second working table is integral to the first working table.

* * * * *